US005795690A

United States Patent [19]

Takegawa et al.

[11] Patent Number: 5,795,690

[45] Date of Patent: Aug. 18, 1998

[54] ELECTROPHOTOGRAPHIC PHOTORECEPTOR, IMAGE FORMING APPARATUS AND IMAGE FORMING PROCESS

[75] Inventors: Ichiro Takegawa; Hidemi Nukada; Hiroshi Yamamoto; Koji Goshima; Takaaki Kimura, all of Minami-ashigara, Japan

[73] Assignee: Fuji Xerox Co., Ltd., Tokyo, Japan

[21] Appl. No.: 784,545

[22] Filed: Jan. 21, 1997

Related U.S. Application Data

[63] Continuation-in-part of Ser. No. 561,231, Nov. 21, 1995, Pat. No. 5,658,702.

[30] Foreign Application Priority Data

Jan. 22, 1996 [JP] Japan ..... 8-008133
Jan. 23, 1996 [JP] Japan ..... 8-008808

[51] Int. Cl.[6] ..... G03G 5/047; G03G 5/14

[52] U.S. Cl. ..... 430/58; 430/62

[58] Field of Search ..... 430/58, 62

[56] References Cited

U.S. PATENT DOCUMENTS 5,270,141 12/1993 Ohtani et al. ..... 430/62
5,389,477 2/1995 Tsuchiya et al. ..... 430/58
5,658,702 8/1997 Nukada ..... 430/58

FOREIGN PATENT DOCUMENTS

A-52-25638 2/1972 Japan .
A-52-10138 1/1977 Japan .
A-52-20836 2/1977 Japan .
A-52-100240 8/1977 Japan .
A-52-121325 10/1977 Japan .
A-54-26739 2/1979 Japan .
A-57-30847 2/1982 Japan .
A-128344 8/1982 Japan .
A-60-111255 6/1985 Japan .
A-61-94057 5/1986 Japan .
A-61-110153 5/1986 Japan .
A-2-59767 2/1990 Japan .
A-3-18858 1/1991 Japan .
A-4-124674 4/1992 Japan .
A-4-162047 6/1992 Japan .

*Primary Examiner*—Roland Martin
*Attorney, Agent, or Firm*—Oliff & Berridge, PLC

[57] ABSTRACT

An electrophotographic photoreceptor is disclosed which comprises an electrically-conductive substrate having provided thereon an undercoat layer and a photosensitive layer, wherein said undercoat layer comprises a crosslinkable matrix and an electron-transporting material.

15 Claims, 1 Drawing Sheet

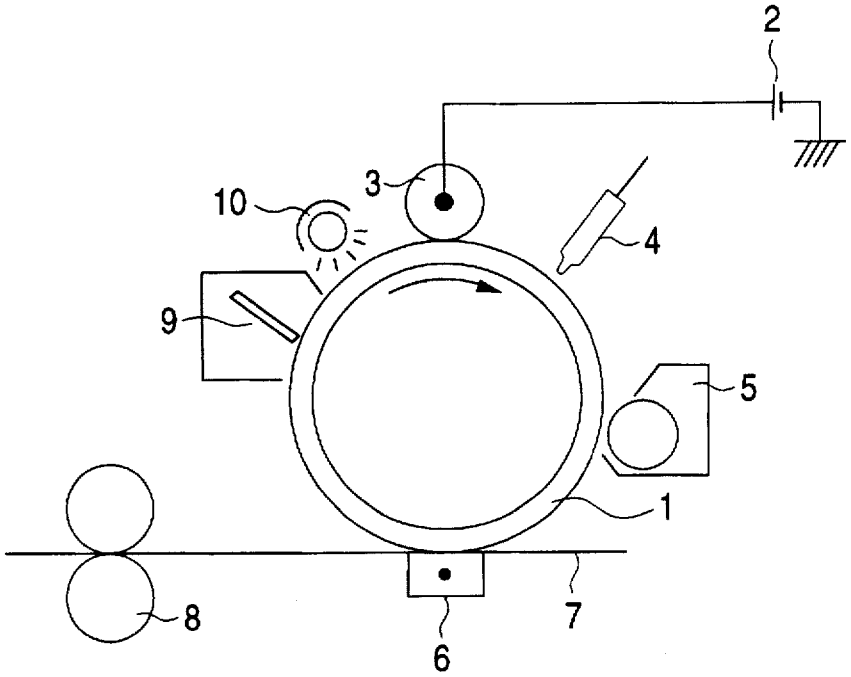
2
3
10
4
9
5
1
8
7
6

ELECTROPHOTOGRAPHIC PHOTORECEPTOR, IMAGE FORMING APPARATUS AND IMAGE FORMING PROCESS

CROSS REFERENCE TO RELATED APPLICATION

This application is a continuation-in-part of U.S. application Ser. No. 561,231, now U.S. Pat. No. 5,658,702 filed Nov. 21, 1995 and issued on Aug. 19, 1997.

FIELD OF THE INVENTION

The present invention relates to an electrophotographic photoreceptor comprising an improved undercoat layer and an image forming process and apparatus using such an electrophotographic photoreceptor.

The present invention also relates to an electrophotographic photoreceptor having a high sensitivity and a high reliability. More particularly, the present invention relates to an electrophotographic photoreceptor having as an undercoat layer a cured film made of an organic metal compound and an electron-transporting material.

BACKGROUND OF THE INVENTION

An electrophotographic apparatus can operate at a high speed to provide a high print quality and thus finds wide application in the art of copying machine, laser beam printer, etc. As the photoreceptor to be incorporated in the electrophotographic apparatus there has been developed and spread an organic photoreceptor (OPC) made of an organic photoconductive material. Referring to the structure of the photoreceptor, the trend is toward a function-separation type photoreceptor in which a charge-generating layer and a charge-transporting layer are separately provided from an electron migration type complex structure or a single-layer type photoreceptor comprising an electron-generating material dispersed in a binder resin. Thus, the properties of photoreceptors have been improved. At present, the most function-separation type photoreceptors comprise an aluminum substrate, an undercoat layer formed on the substrate, and a charge-generating layer and a charge-transporting layer formed on the undercoat layer.

With the progress of electrophotographic apparatus, photoreceptors which can provide a higher image quality have been desired. Concerning the improvement of the repetition stability or environmental stability of photoreceptors, all of the charge-generating layer, charge-transporting layer and undercoat layer have important effects on electrophotographic properties such as sensitivity, image quality and repetition stability. As the substrates there have been used various materials such as extruded pipe, ED pipe and El pipe for the purpose of reducing cost or eliminating image defects. Further, the roughening of the surface of the substrate has been studied for the purpose of eliminating interference band.

However, the surface of the substrate has many defects such as deposit, pickup and indentation. For example, ED pipe used as a low cost pipe has burr on the surface of aluminum substrate called pickup. These pickups have been found to have a size of up to 20 μm. If such surface defects occur, the resulting photoreceptor has nonuniformity in the film condition, causing local concentration of electric field that results in charge leakage when the photoreceptor is charged. Further, if such a photoreceptor is used in a contact-charging process employing a charging roll, the foregoing surface defects or coating defects on the electrically-conductive substrate causes charge leakage between the photoreceptor and the charging roll, resulting in the occurrence of black or white spot defects on the leaked area. If this phenomenon is remarkable, the charging capacity of the charging roll itself is reduced, causing defective charging throughout the axial length of the photoreceptor.

In some photoreceptors, the aluminum substrate is roughened by honing, roughing cut, etching or the like to inhibit the generation of interference band. However, roughening may cause the occurrence of local abnormal protrusions on the surface of the substrate. This case, too, is disadvantageous in that image defects occur and current leakage occurs when the charging roll and the photoreceptor are brought into contact with each other. These problems can be effectively solved by forming an undercoat layer having a sufficient capacity of opacifying substrate and sufficient carrier blocking properties or an electrically-conductive layer on the surface of the substrate to opacify defects on the substrate.

As the materials to be used in the undercoat layer to be formed on the surface of the substrate there are disclosed various resins. For example, a ester maleate copolymer is disclosed in JP-A-52-10138 (The term "JP-A" as used herein means an "unexamined published Japanese patent application"). A polyester resin is disclosed in JP-A-52-20836. A copolymer nylon is disclosed in JP-A-52-25638. A polyvinyl alcohol is disclosed in JP-A-52-100240. An epoxy resin is disclosed in JP-A-52-121325. A styrene butadiene resin is disclosed in JP-A-54-26739. As the process for the formation of an electrically-conductive layer there is proposed the dispersion of a metal oxide such as titanium oxide and tin oxide in a resin such as polyamide resin (JP-A-61-110153), phenolic resin (JP-A-60-111255), epoxy resin (JP-A-61-110153) and urethane resin (JP-A-61-110153).

However, if such an undercoat layer or electrically-conductive layer is formed, electrical properties are subject to secondary troubles such as rise in residual potential and environmental change of residual potential. Further, the formation of such an undercoat layer or electrically-conductive layer leaves something to be desired in the effect of eliminating image defects such as black or white spot.

In an attempt to lower the resistance of the undercoat layer for the purpose of enhancing electrical properties and improving image quality, the incorporation of a particulate metal oxide or a particulate metal in the resin to be used in the undercoat layer has been tried. However, the incorporation of a particulate metal oxide or a particulate metal in the resin is disadvantageous in that an electrically-conductive passage is formed in the undercoat layer, causing the injection of holes from the substrate that results in the generation of fog or white mark.

If used in the contact-charging process employing a charging roll, even a photoreceptor which causes no image defects with ordinary scorotron can cause charge leakage with respect to the charging roll. This results in the occurrence of black or white spot defects. In some extreme cases, the charging capacity of the charging roll itself is reduced, a causing defective charging throughout the axial length of the photoreceptor. In order to inhibit the occurrence of leakage, it is effective to raise the thickness of the undercoat layer as much as possible. Conventional undercoat layer materials can provide good electrical properties when its thickness is up to about 1 μm. However, when its thickness is greater than 1 μm, these materials normally show a remarkable rise in residual potential to a practically unacceptable level. In order to inhibit the occurrence of current leakage due to the contact-charging roll, it is desired that the thickness of the undercoat layer be not less than about 3 μm. It has thus been desired to provide an undercoat layer which causes no defects in electrical properties and image quality even when its thickness is thus raised.

The formation of an undercoat layer or interlayer by a curable compound which undergoes polycondensation upon hydrolysis of organic metal compound is described in JP-A-61-94057 (The term "JP-A" as used herein means an "unexamined published Japanese patent application"), JP-A-2-59767, JP-A-3-18858, JP-A-4-124674, and JP-A-4-162047 and thus has heretofore been known.

Among carriers produced in the charge-generating layer, positive holes migrate through the charge-transporting layer and then re-combine with charge on the surface of the charge-transporting layer. Electrons need to migrate through the undercoat layer to re-combine with induced charge on the substrate. However, if the undercoat layer has a low electron-transporting capacity, electrons are kept localized in the undercoat layer or at the interface of the undercoat layer with the charge-generating layer. If the photoreceptor is repeatedly used, the rise in residual potential or image defects occur. Therefore, it is necessary that the undercoat layer be provided with a high electron-transporting capacity. However, the electrophotographic photoreceptor comprising an undercoat layer formed by the foregoing curable compound leaves something to be desired in electrical properties.

In the light of the foregoing problems of the prior art, the inventors worked out the present invention for the purpose of forming an undercoat layer material which provides a higher image quality and has no adverse effects on electrical properties.

SUMMARY OF THE INVENTION

An object of the present invention to provide an electrophotographic photoreceptor which exhibits excellent electrical properties and little image defects.

Another object of the present invention to provide an electrophotographic photoreceptor which can form an image free of image defects when used in contact charging system image forming process and an image forming process and apparatus using such an electrophotographic photoreceptor.

A further object of the present invention to provide an electrophotographic photoreceptor comprising an improved undercoat layer and having a high sensitivity and excellent image quality and repetition stability.

The inventors made studies of an undercoat layer-forming material which provides a high image quality and has no adverse effects on electrical properties. As a result, it was found that the incorporation of a copolymer resin having a hydrolyzable silyl group and an electron-transporting organic pigment makes it possible to accomplish the foregoing objects. Thus, the present invention has been worked out.

The inventors made studies of undercoat layer which can provide a higher sensitivity, image quality and repetition stability in this respect. As a result, it was found that the use of a curable film comprising an electron-transporting material and an organic metal compound incorporated therein as an undercoat layer makes it possible to accomplish the foregoing object. The present invention has been thus worked out.

The electrophotographic photoreceptor of the present invention comprises a charge-generating layer and a charge-transporting layer sequentially laminated on an electrically-conductive support, characterized in that a cured film made of either or both of an organic metal compound and a silane coupling agent, an electron-transporting and a binder resin is provided interposed between said electrically-conductive support and said charge-generating layer as an undercoat layer.

The present invention concerns an electrophotographic photoreceptor comprising an undercoat layer provided interposed between an electrically-conductive substrate and a photosensitive layer, characterized in that said undercoat layer comprises a copolymer resin having a hydrolyzable silyl group and an electron-transporting organic pigment incorporated therein. In the present invention, the foregoing copolymer having a hydrolyzable silyl group is preferably an acrylic copolymer resin. The undercoat layer may comprise a particulate metal oxide incorporated therein.

The image forming process of the present invention comprises the steps of charging an electrophotographic photoreceptor, subjecting the electrophotographic photoreceptor thus charged to imagewise exposure, developing the electrophotographic photoreceptor thus exposed, transferring the image thus formed, and then fixing the image, characterized in that as said electrophotographic photoreceptor there is used one according to claims and a charging apparatus is brought into contact with the surface of said electrophotographic photoreceptor so that electric charge is externally supplied thereinto to charge said electrophotographic photoreceptor.

The image forming apparatus of the present invention comprises an electrophotographic photoreceptor and a charging apparatus, characterized in that said electrophotographic photoreceptor is one according to claims and said charging apparatus is brought into contact with the surface of said electrophotographic photoreceptor so that electric charge is externally supplied thereinto to charge said electrophotographic photoreceptor.

BRIEF DESCRIPTION OF THE DRAWING

The attached FIGURE is a schematic view illustrating the configuration of a printer apparatus used in the image forming process of the present invention.

DETAILED DESCRIPTION OF THE INVENTION

Embodiments of the present invention will be further described hereinafter.

The electrophotographic photoreceptor of the present invention comprises an undercoat layer formed on an electrically-conductive substrate, and a photosensitive layer formed on the undercoat layer. The photoreceptor may have any layer structure. A lamination type photoreceptor having a charge-transporting layer as a surface layer is desirable because it is excellent in properties such as repetition stability and environmental stability. The present invention will be further described with reference mainly to the lamination type photoreceptor having a charge-transporting layer as a surface layer.

As the electrically-conductive substrate there may be used a metal such as copper, aluminum, nickel and iron. Alternatively, an electrically-conducted plastic or paper cylindrical, belt-like or sheet-like substrate having a metal evaporated thereonto or an electrically-conductive powder-dispersed coat layer formed thereon may be used.

In order to inhibit the generation of interference band, the surface of the electrically-conductive substrate may be roughened by various methods such as etching, anodization, wet blasting, sandblasting, roughing cut and centerless cut.

In the present invention, the undercoat layer comprises a crosslinkable matrix and an electron-transporting material.

On the surface of the electrically-conductive substrate is formed an undercoat layer for the purpose of stabilizing electrical properties, inhibiting image defects and enhancing chargeability and adhesivity. The undercoat layer of the present invention is a curable film made of either or both of an organic metal compound and a silane coupling agent, an electron-receptive compound and a binder resin.

In the undercoat layer, the curing treatment with an organic metal compound or silane coupling agent prevents the elution of a low molecular electron-transporting material during the coating of the upper layer, making it possible to form an electrophotographic photoreceptor having a higher stability. Further, the use of the organic metal compound or silane coupling agent makes it possible to obtain an excellent electrophotographic photoreceptor which otherwise cannot be obtained. The excellent electrophotographic properties such as high light decay and low residual potential of the electrophotographic photoreceptor of the present invention cannot be obtained when other curable resins are used.

The foregoing electrically-conductive substrate has an undercoat layer provided thereon. In the present invention, the undercoat layer comprises a copolymer resin having a hydrolyzable silyl group and an electron-transporting organic pigment incorporated therein but may comprise other film-forming materials incorporated therein. For the purpose of accelerating the curing reaction, the undercoat layer may comprise a curing catalyst for hydrolyzable silyl group incorporated therein. If it is intended to lower the resistance of the material, the undercoat layer may comprise a particulate electrically-conductive material incorporated therein. Further, the undercoat layer may comprise two layers, i.e., first undercoat layer having a particulate electrically-conductive material incorporated therein and second undercoat layer free of particulate electrically-conductive material.

Examples of the copolymer resin having a hydrolyzable silyl group to be incorporated in the undercoat layer of the present invention include a vinyl copolymer made of (a) vinyl monomer having a hydrolyzable silyl group and (b) other vinyl monomers copolymerizable therewith. Examples of the hydrolyzable silyl group to be incorporated in the vinyl monomer (a) having a hydrolyzable silyl group include halogenosilyl group, acyloxysilyl group, amidesilyl group, amidoxysilyl group, aminoxysilyl group, alkenyloxysilyl group, aminosilyl group, oximsilyl group, alkoxysilyl group, and thioalkoxysilyl group. Preferred among these hydrolyzable silyl groups is alkoxysilyl group.

Examples of the vinyl monomer (b) having an alkoxysilyl group include vinylsilane (e.g., vinyl methyl dimethoxysilane, vinyl trimethoxysilane, vinyl triethoxysilane, vinyl tris(β-methoxyethoxy)silane), and acryloxy- or methacryloxyalkylsilane having an alkoxysilyl group (e.g., β-methacryloxypropyl methoxysilane, β-metacryloxypropyl methyl dimethoxysilane, β-acryloxypropyl trimethoxysilane, β-methacryloxypropyl methyl diethoxysilane, β-acryloxypropyl triethoxysilane).

Examples of the vinyl monomer (b) copolymerizable with the vinyl monomer (a) include (1) acryl- or methacrylic alkyl ester (alkyl group has from 1 to 20 carbon atoms) [e.g., methyl acrylate, methyl methacrylate, ethyl acrylate, ethyl methacrylate, n-butyl acrylate, n-butyl methacrylate, 2-ethylhexyl acrylate, 2-ethylhexyl methacrylate, 2-hydroxyethyl acrylate, 2-hydroxyethyl methacrylate], (2) aromatic vinyl monomer [e.g., styrene, α-methylstyrene, α-chlorostyrene], (3) halogenated vinyl monomer [e.g., vinyl chloride], (4) alkyl or cycloalkyl vinyl ether [e.g., methyl vinyl ether, cyclohexyl vinyl ether], (5) vinyl ester [e.g., vinyl acetate], (6) nitrile group-containing vinyl monomer [e.g., acrylonitrile], (7) amide group-containing vinyl monomer [e.g., acrylamide, methacrylamide, crotonamide, N-methylolacrylamide, diamide fumarate], (8) epoxy group-containing vinyl monomer [e.g., glycidyl acrylate, glycidyl methacrylate], (9) vinyl monomer having a fluorine-substituted alkyl group [e.g., acrylic ester and methacrylic ester having a perfluoroalkyl group such as perfluorooctylethyl, perfluoroalkyl group-containing maleic ester such as $C_8F_{17}(CH_2)_{11}OCOCH{=}CHCOOCH_3$, perfluoroalkyl group-containing vinyl ether such as $C_7F_{15}CH_2OCH{=}CH_2$], (10) polydimethylsiloxane-containing vinyl monomer [e.g., $CH_2{=}CHCOO(CH_2)_3[Si(CH_3)_2O]_nSi(CH_3)_3$, $CH_2{=}C(CH_3)COOC_6H_4[Si(CH_3)_2O]_nSi(CH_3)_3$, $CH_2{=}C(CH_3)COO(CH_2)_3[Si(CH_3)_2O]_nSi(CH_3)_3$, $CH_2{=}C(CH_3)COO(CH_2)_3[Si(C_6H_5)_2O]_nSi(CH_3)_3$ (in which n represents an integer of from 0 to 130], (11) unsaturated mono- or polycarboxylic acid [e.g., acrylic acid, methacrylic acid, crotonic acid, sorbic acid, maleic acid, itaconic acid, cinnamic acid], (12) aliphatic or aromatic vinylsulfonic acid [e.g., vinylsulfonic acid, allylsulfonic acid, vinyltoluenesulfonic acid, styrenesulfonic acid], (13) acryl- or methacrylsulfonic ester [e.g., ethyl acrylsulfonate, ethyl methacrylsulfonate, propyl acrylsulfonate, propyl methacrylsulfonate], and (14) polyoxyethylene group-containing vinyl monomer [e.g., $CH_2{=}C(R)COOCH_2CH_2O(CH_2CH_2O)_lH$, $CH_2{=}C(R)COOCH_2CH_2CH_2O(CH_2CH_2O)_lH$, $CH_2{=}C(R)COOCH_2CH_2O(CH_2O)_lR'$, $CH_2{=}C(R)COOCH_2CH_2CH_2O(CH_2CH_2O)_lR'$ (in which R represents a hydrogen atom, l represents an integer of from 1 to 200, and R' represents a $C_{1-10}$ alkyl group), $CH_2{=}C(R)COO(EO/PO)_mH$, $CH_2{=}C(R)COO(EO/PO)_mR'$ (in which R represents a hydrogen atom or $CH_3$, m represents an integer of from 1 to 200, EO represents an oxyethylene group, PO represents an oxypropylene group, with the proviso that EO/PO is greater than 2 (molar ratio), and R' represents a $C_{1-10}$ alkyl group)].

Preferred among the foregoing other vinyl monomers (b) copolymerizable with the vinyl monomer (a) are anionic or nonionic hydrophilic group-containing vinyl monomers ((11) to (14)). Particularly preferred among these other vinyl monomers is polyoxyethylene group-containing vinyl monomer (14). Two or more of the foregoing vinyl monomers (b) may be used in combination. Referring to the proportion of the foregoing monomer (a) and monomer (b) constituting the copolymer resin having a hydrolyzable silyl group, the proportion of the monomer (a) is normally from 0.01 to 80% by weight, preferably from 0.5 to 60% by weight, while the proportion of the monomer (b) is normally from 20 to 99.99% by weight, preferably from 40 to 99.5% by weight.

The preparation of the copolymer resin having a hydrolyzable silyl group can be accomplished by subjecting the foregoing monomer (a) and monomer (b) to radical polymerization such as heat polymerization, photopolymerization and radiation-induced polymerization. Preferred among these radical polymerization methods is one to which the monomer (a) and (b) are subjected in an organic solvent in the presence of a radical polymerization initiator. Examples of the organic solvent in which the foregoing radical polymerization is effected include toluene, xylene, methyl ethyl ketone, methyl isobutyl ketone, n-butyl acetate, cellosolve acetate, and ethylene dichloride. These organic solvents may be used in combination.

As the radical polymerization initiator there may be effectively used an azo compound (e.g., azobisisobutylonitrile, azobisisovaleronitrile). If necessary, a chain transfer agent (e.g., n-lauryl mercaptan, n-dodecyl mercaptan, mercaptopropionic acid, t-dodecyl mercaptan, β-mercaptopropyl trimethoxysilane, β-mercaptopropyl methyl dimethoxysilane) may be used in combination with the radical polymerization initiator to adjust the molecular weight of the polymerization product. The molecular weight of the copolymer resin having a hydrolyzable silyl group is not specifically limited but is normally from 1,000 to 100,000.

As the curing catalyst used for the purpose of accelerating the curing reaction of the copolymer resin having a hydrolyzable silyl group there may be used one which has heretofore been used. Examples of the curing catalyst employable herein include organic titanate compound (e.g., isopropyl triisostearoyl titanate, isopropyl tri (dioctylpyrophosphate) titanate, tetraisopropyl di (laurylphosphite) titanate), organic aluminum compound (e.g., acetoalkoxy aluminum diisopropylate), carboxylic acid type tin compound (e.g., tin dioctanate, dibutyl tin dilaurate, dibutyl tin malate), sulfide type or mercapto type sulfur-containing organic tin compound (e.g., dibutyl tin sulfide), dialkyl tin oxide (e.g., dibutyl tin oxide, dioctyl tin oxide), carboxylic acid metal salt (e.g., sodium acetate, zinc caproate, lead octylate, cobalt naphthenate), acidic ester phosphate (e.g., monomethyl acidic ester phosphate, dimethyl acidic ester phosphate, dimethyl acidic ester phosphate, diethyl acidic ester phosphate, monobutyl acidic ester phosphate), carboxylic acid and anhydride thereof (e.g., adipic acid, maleic acid, citric acid, itaconic acid, succinic acid, phthalic acid, trimellitic acid, maleic anhydride, phthalic anhydride), aminosilane (e.g., β-aminopropyltriethoxysilane), amine and salt thereof (e.g., triethylamine, dibutylamine-2-hexoate, cyclic amidine, salt thereof), and quaternary ammonium salt (e.g., tetrabutyl ammonium hydroxide).

These curing catalysts may be used singly or in combination. The amount of the curing catalyst, if added, is normally from 0.001 to 20% by weight based on the weight of the copolymer resin used.

In the present invention, the undercoat layer may comprise an electron-transporting organic pigment incorporated therein. In this arrangement, electrons generated in the charge-generating layer can be readily migrated toward the substrate to inhibit the accumulation of electrons in the undercoat layer that causes the rise in the residual potential, making it possible to obtain stable electrical characteristics. In other words, the incorporation of an electron-transporting organic pigment allows the undercoat layer to act as a layer resisting the injection of holes from the substrate, making it possible to inhibit the occurrence of image defects due to the injection of holes.

In the present invention, an electron-transporting organic pigment may be used. Whether the organic pigment is capable of transporting positive holes or electrons can be judged by determining which is higher the capability of transporting positive holes or the capability of transporting electrons. In some detail, a coat layer having a thickness of several micrometers to 10 μm having the organic pigment dispersed in a binder resin is charged positively or negatively. Which charging electrode exhibits a higher sensitivity is then determined. If a higher sensitivity is shown in negative charging, the organic pigment is judged to be an electron-transporting organic pigment. Some pigments cannot form a carrier when used singly. In this case, judgement can be conducted as follows. In some detail, on a coat layer having a thickness of several micrometers to 10 μm having the organic pigment dispersed in a binder resin is formed a charge-generating layer having a thickness on the order of submicron made of different material. The electron-generating layer is then irradiated with light of wavelength range to which it is sensitive to form a carrier which is then injected into the underlying organic pigment. The transporting polarity of the organic pigment can then be judged by determining at which charging polarity a higher potential decay occurs. In another judgement method, on a coat layer having a thickness of several micrometers to 10 μm having the organic pigment dispersed therein is formed an charge-transporting layer having a thickness as small as submicron to 1 μm. The charge-transporting layer is then irradiated with light of wavelength range to which the organic pigment to be judged is sensitive to generate a carrier at the interface of the pigment with the thin charge-transporting layer. The carrier thus generated is then injected into the organic pigment layer. Judgement is then accomplished by determining at which charging polarity a higher potential decay occurs.

Examples of the electron-transporting organic pigment compound to be thus judged include diimide perylene tetracarboxylate pigment, diimidazole perylene tetracarboxylate pigment, polycyclic quinone pigment, anthraquinone acridone pigment, and diimidazole naphthalene tetracarboxylate pigment.

Specific examples of diimide perylene tetracarboxylate pigment include the following exemplified Compound Nos. 1-1 to 1-10. Specific examples of diimidazole perylene tetracarboxylate pigment include the following exemplified Compound Nos. 2-1 to 2-7. Specific examples of anthraquinone acridone pigment include the following exemplified Compound Nos. 3-1 to 3-40. Specific examples of polycyclic quinone pigment include the following exemplified Compound Nos. 4-1 to 4-41. Specific examples of diimidazole naphthalene tetracarboxylate pigment include the following exemplified Compound Nos. 5-1 to 5-9.

(Specific examples of diimide perylene tetracarboxylate pigment)

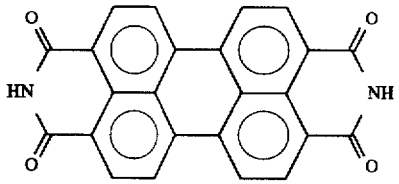

No. 1-1

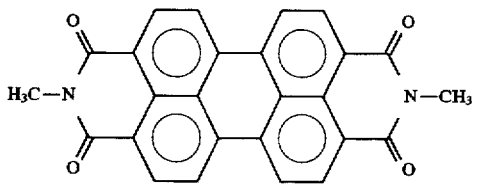

No. 1-2

-continued
No. 1-3
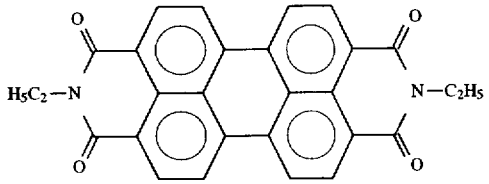
No. 1-4
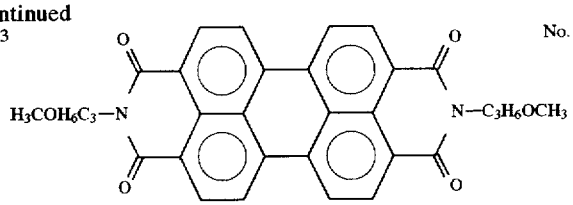
No. 1-5
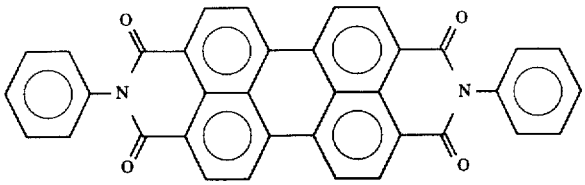
No. 1-6
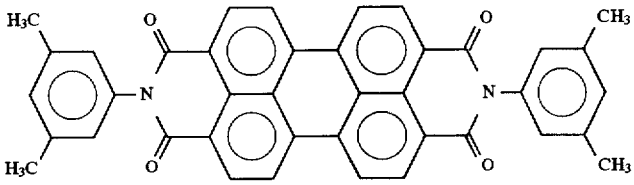
No. 1-7
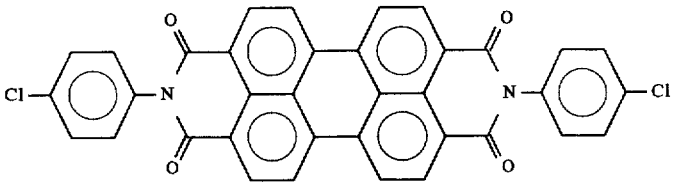
No. 1-8
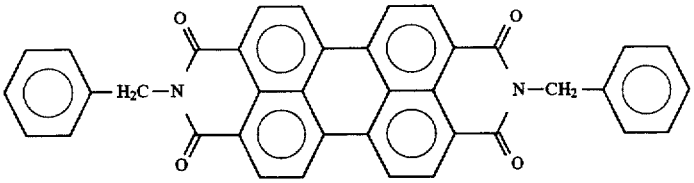
No. 1-9
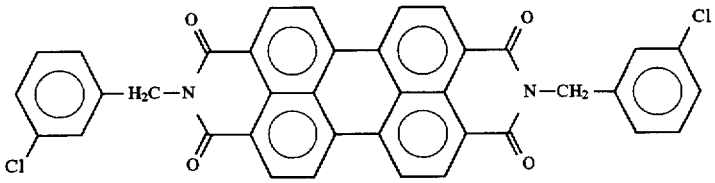
No. 1-10
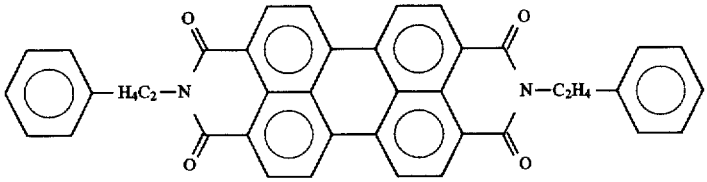
(Specific examples of diimidazole perylene tetracarboxylate pigment)
Compounds in cis form and mixture of compounds in cis form and trans form are omitted.
No. 2-1
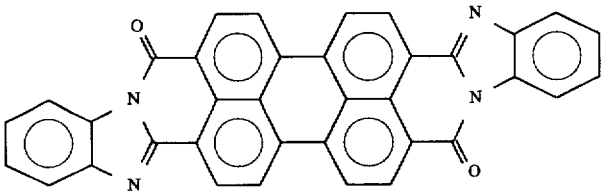

-continued
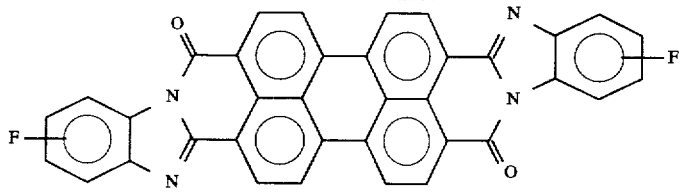
No. 2-2
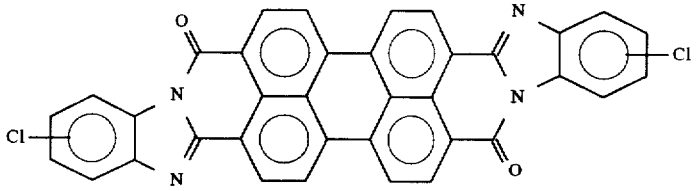
No. 2-3
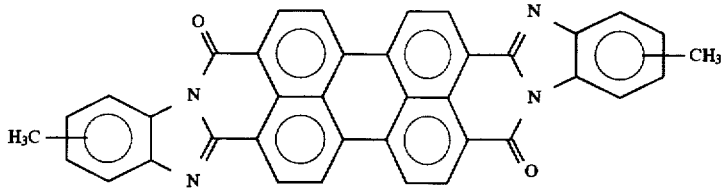
No. 2-4
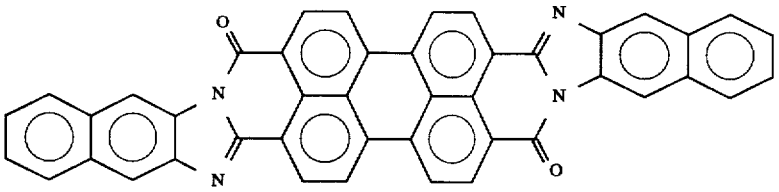
No. 2-5
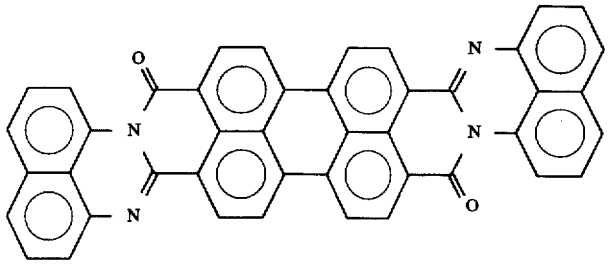
No. 2-6
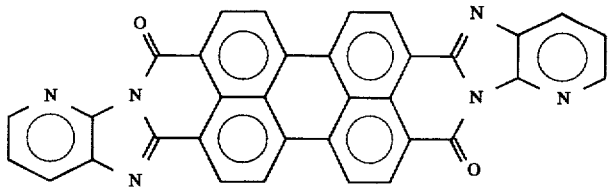
No. 2-7
(Specific examples of anthraquinone acridone pigment)
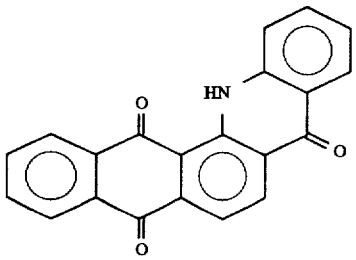
No. 3-1
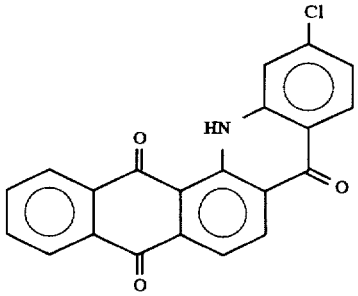
No. 3-2

-continued
No. 3-3
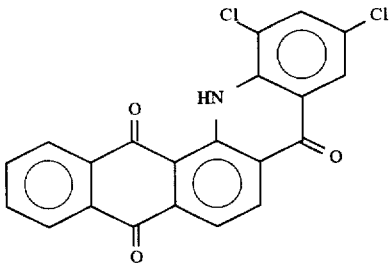
No. 3-4
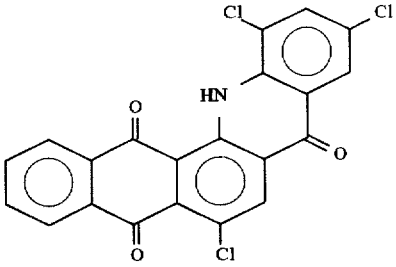
No. 3-5
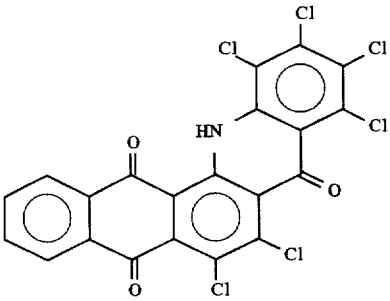
No. 3-6
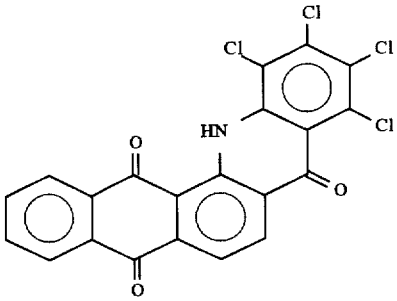
No. 3-7
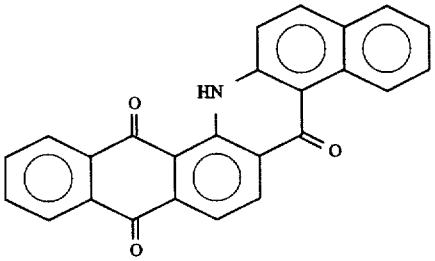
No. 3-8
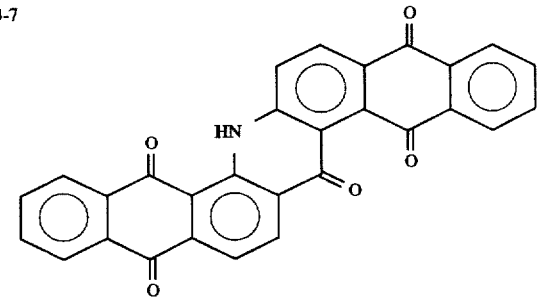
No. 3-9
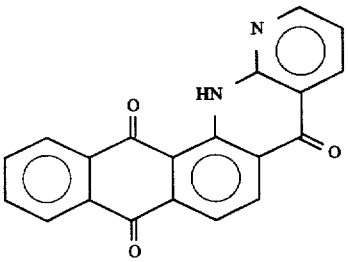
No. 3-10
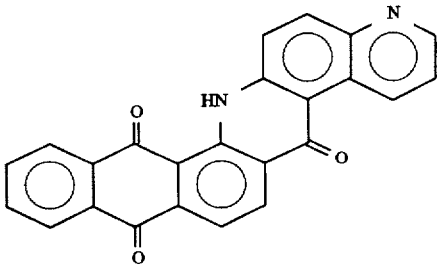
No. 3-11
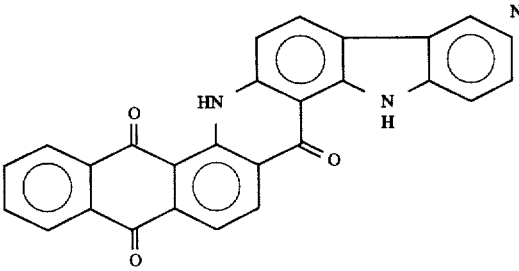
No. 3-12
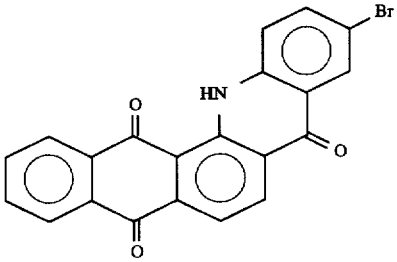

-continued
No. 3-13
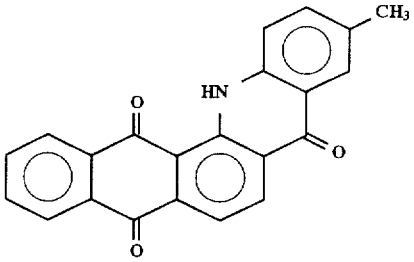
No. 3-14
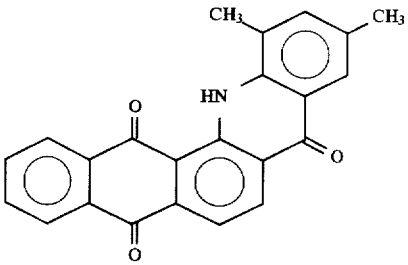
No. 3-15
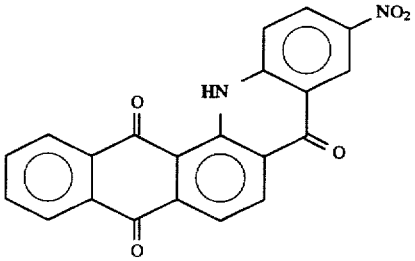
No. 3-16
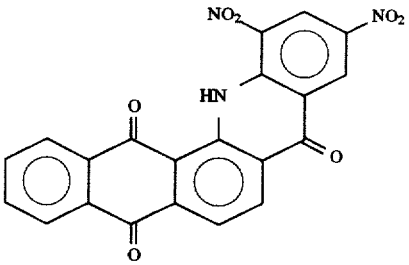
No. 3-17
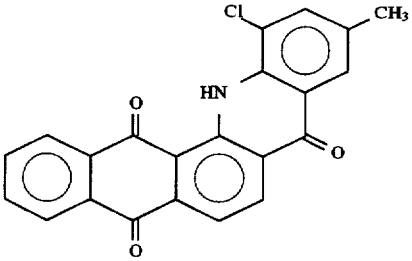
No. 3-18
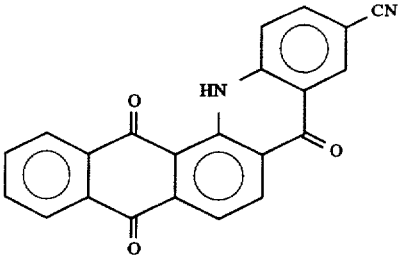
No. 3-19
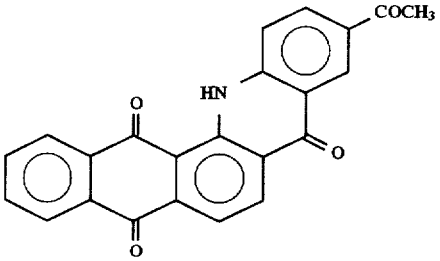
No. 3-20
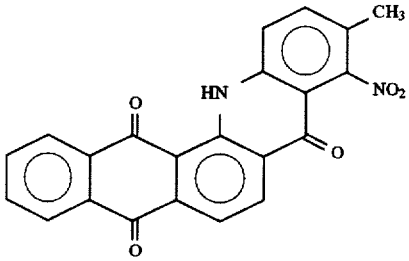
No. 3-21
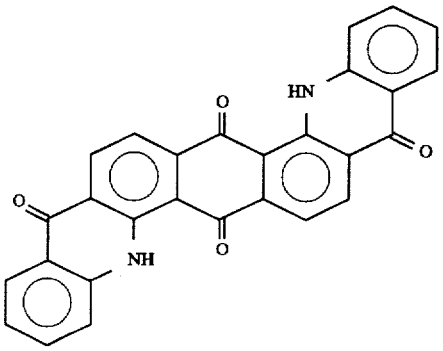
No. 3-22
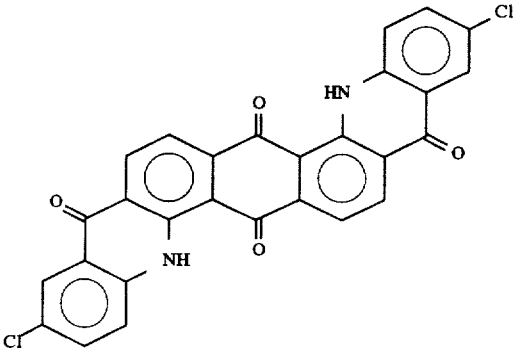

-continued
No. 3-23
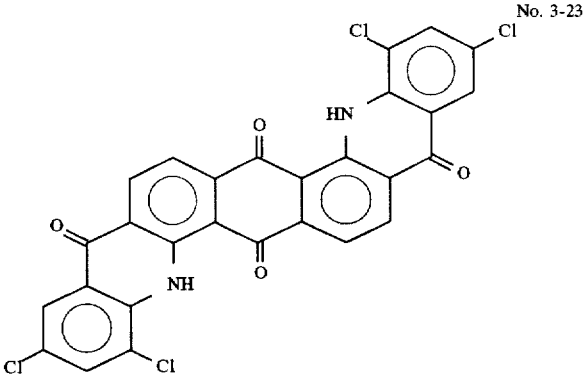
No. 3-24
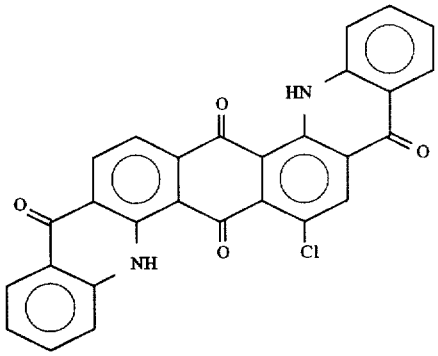
No. 3-25
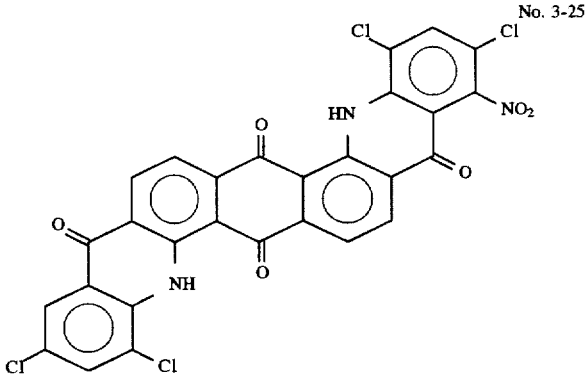
No. 3-26
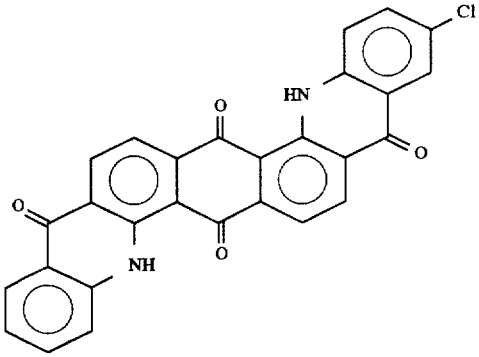
No. 3-27
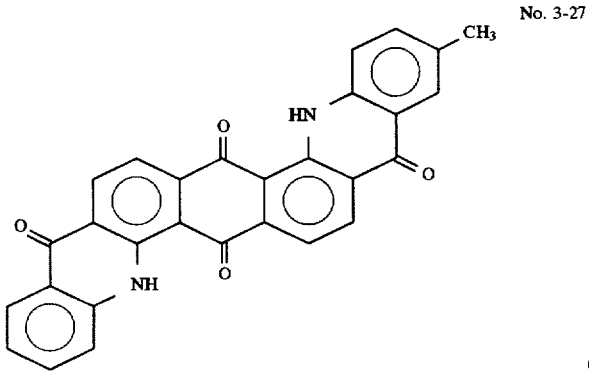
No. 3-28
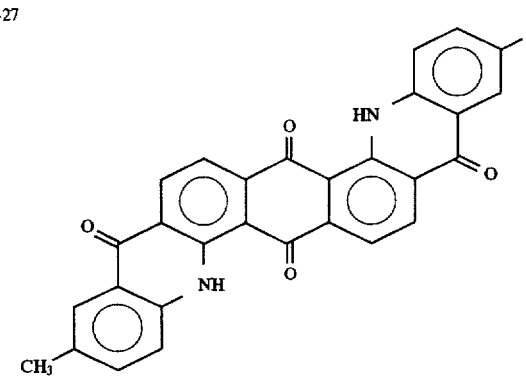
No. 3-29
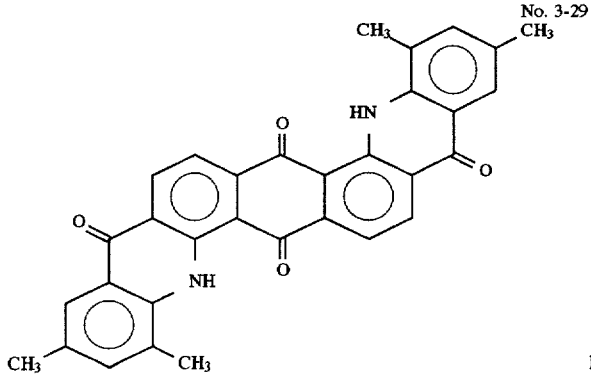
No. 3-30
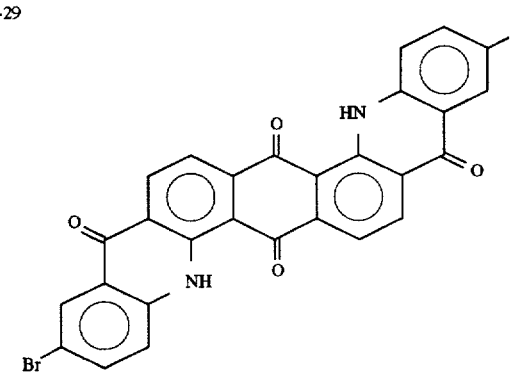

-continued
No. 3-31
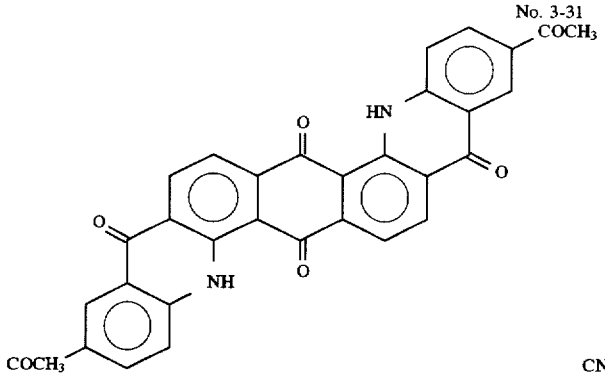
No. 3-32
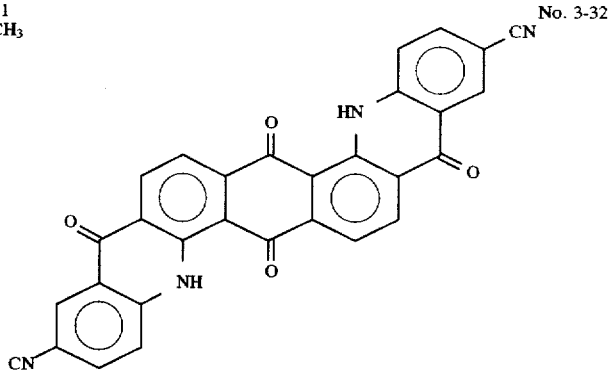
No. 3-33
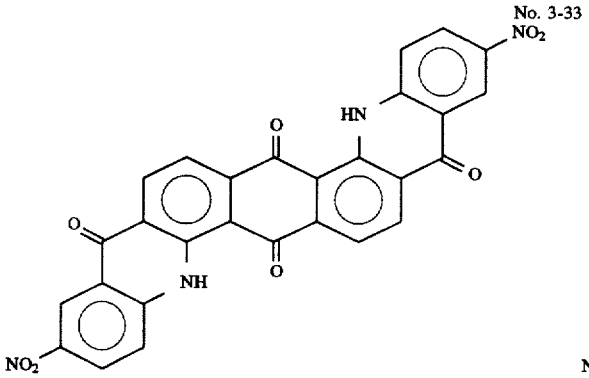
No. 3-34
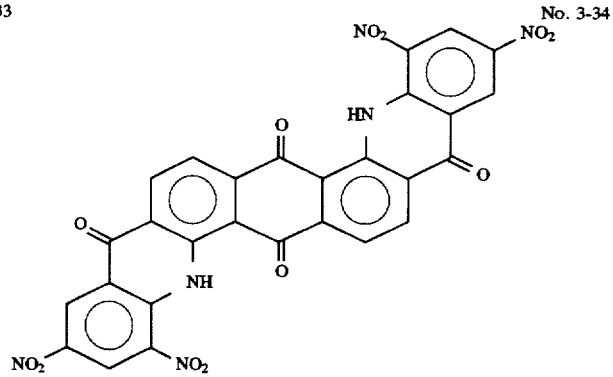
No. 3-35
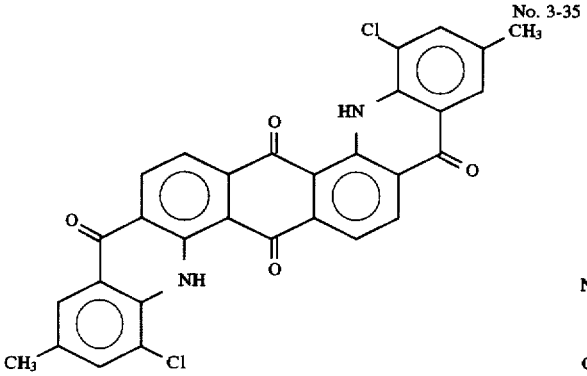
No. 3-36
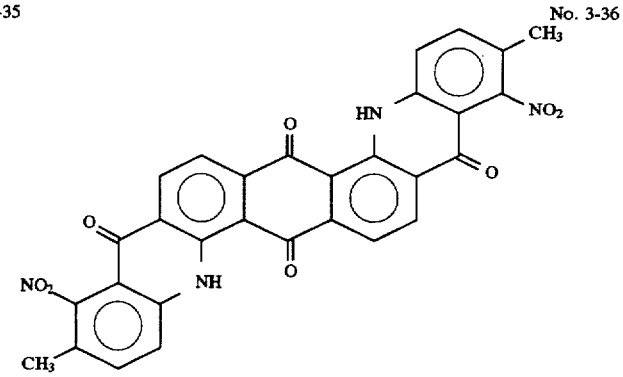
No. 3-37
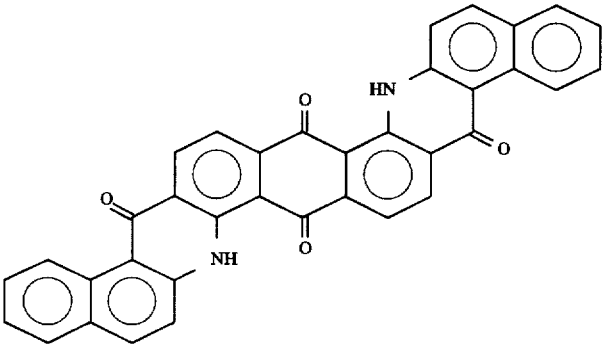

-continued
No. 3-38
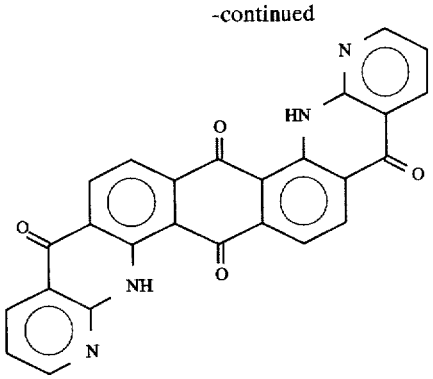
No.3-39
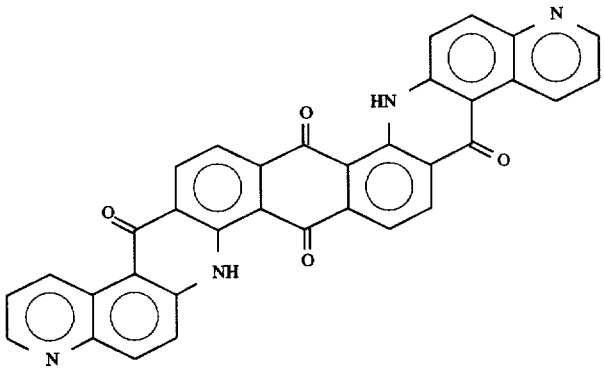
No. 3-40
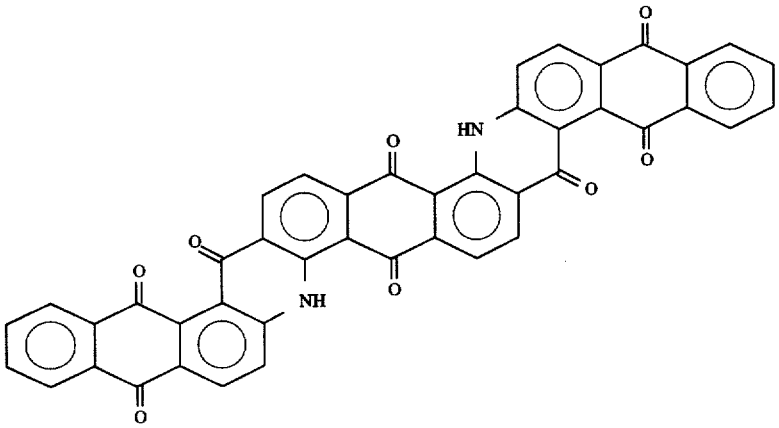
(Specific examples of polycyclic quinone pigment)
No. 4-1
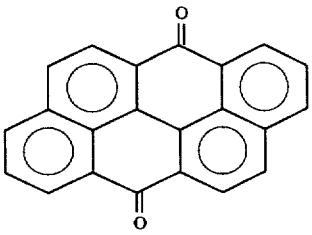
No. 4-2
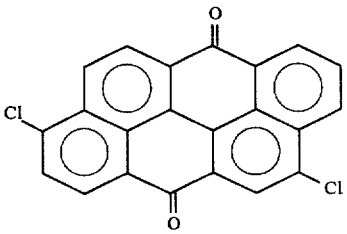
No. 4-3
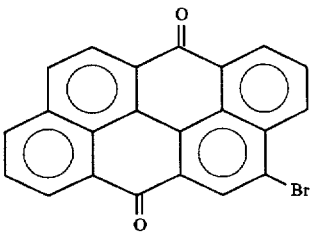
No. 4-4
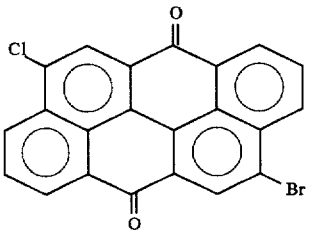

-continued
No.4-5
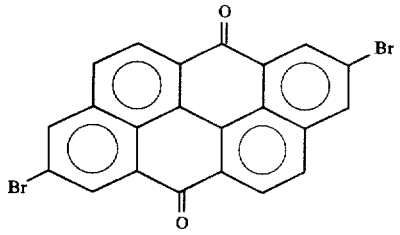
No. 4-6
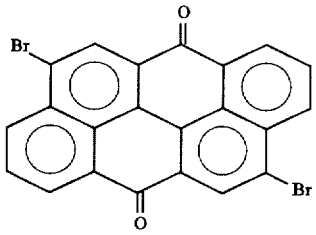
No. 4-7
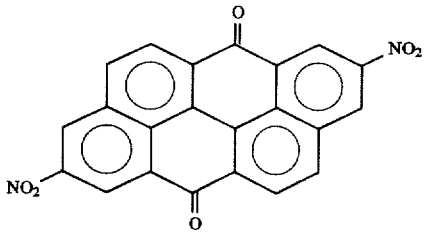
No. 4-8
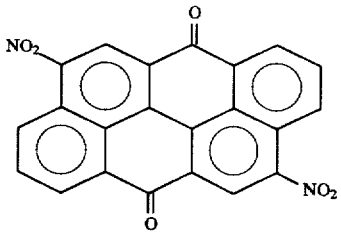
No. 4-9
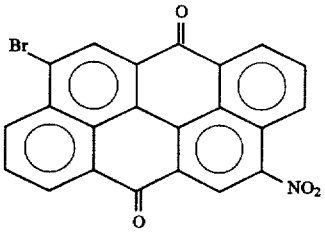
No. 4-10
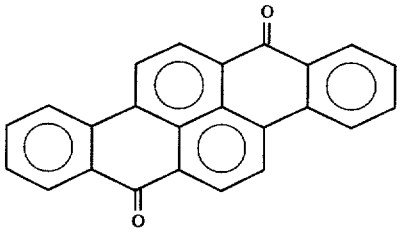
No. 4-11
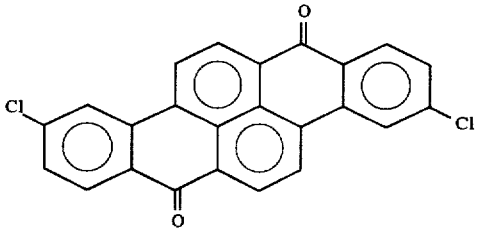
No. 4-12
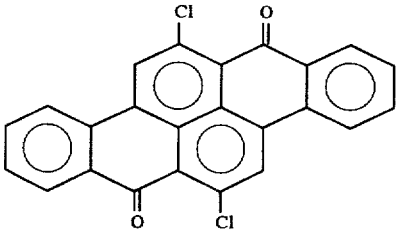
No. 4-13
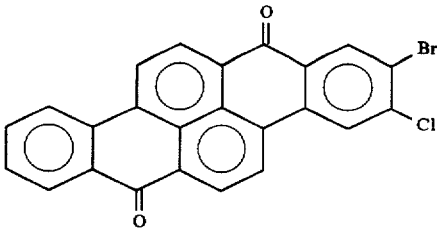
No. 4-14
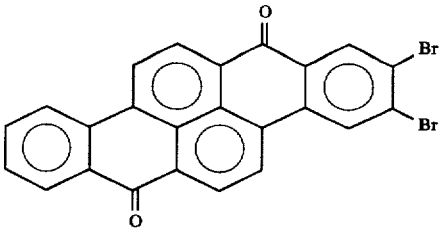
No. 4-15
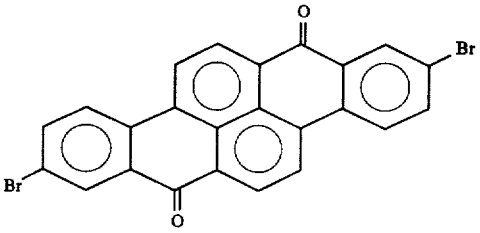
No. 4-16
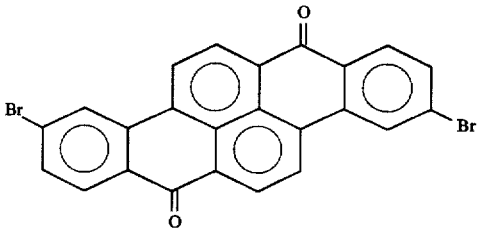

-continued
No. 4-17
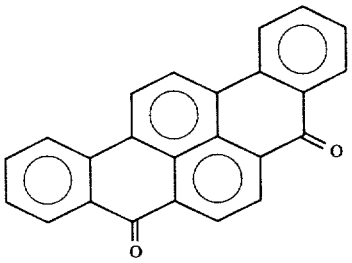
No. 4-18
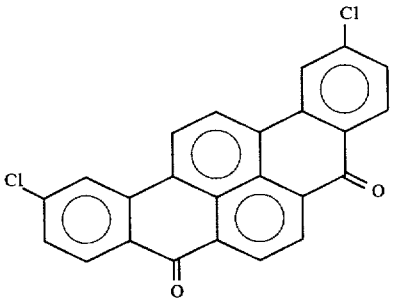
No. 4-19
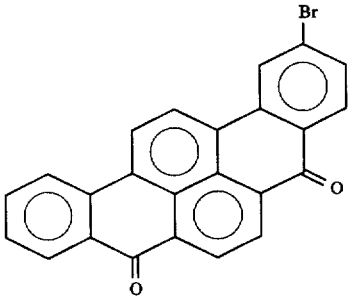
No. 4-20
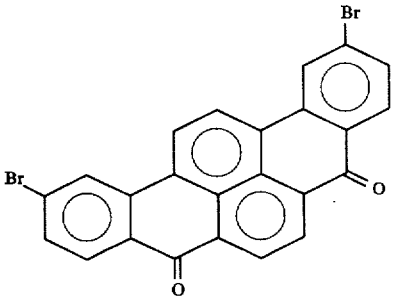
No. 4-21
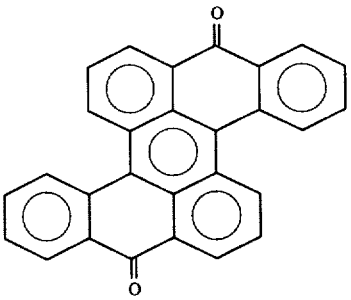
No.4-22
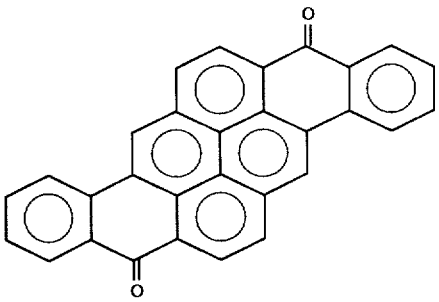
No.4-23
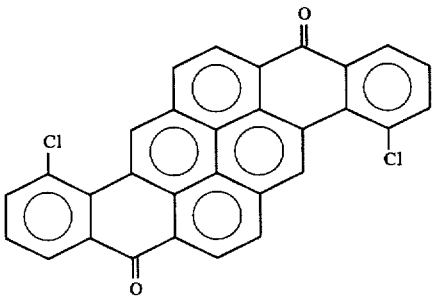
No.4-24
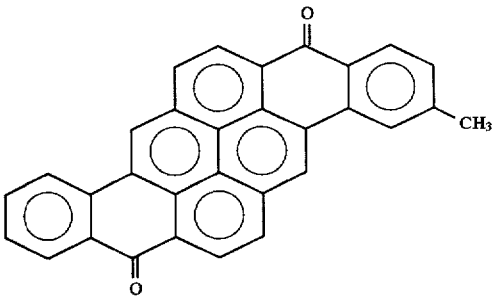
No.4-25
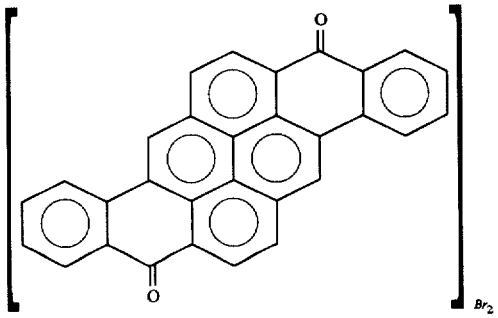
No. 4-26
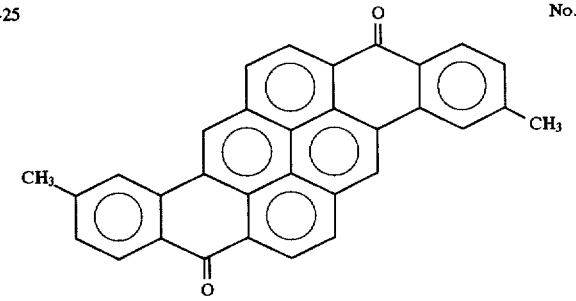

-continued
No. 4-27
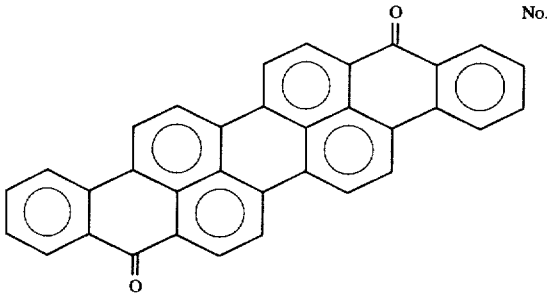
No. 4-28
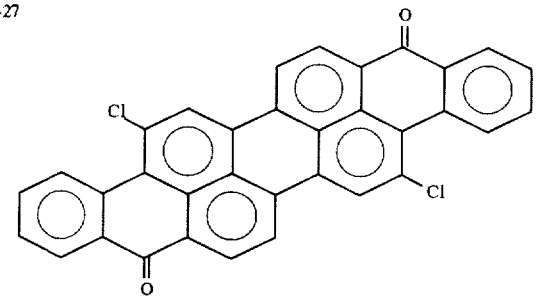
No. 4-29
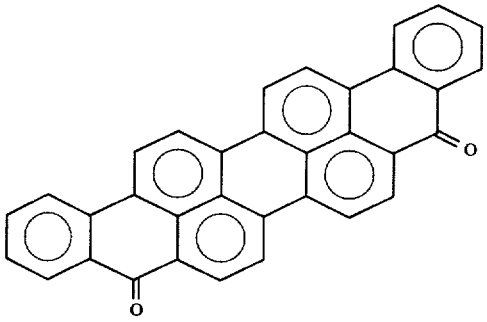
No. 4-30
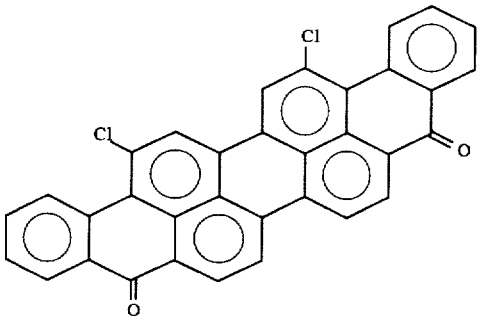
No. 4-31
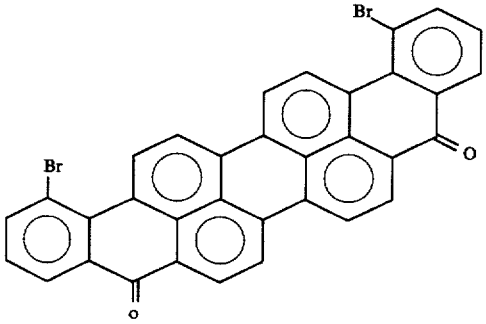
No. 4-32
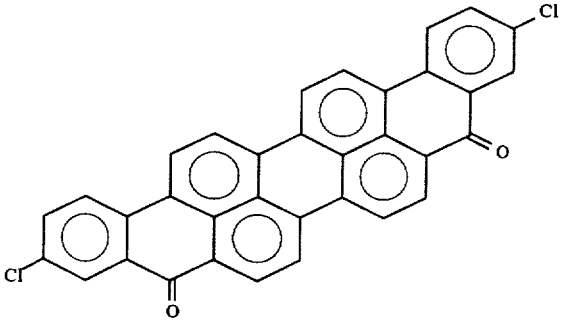
No. 4-33
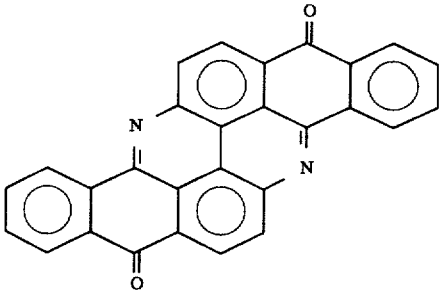
No. 4-34
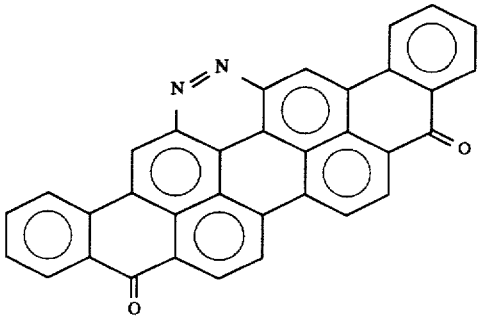
No. 4-35
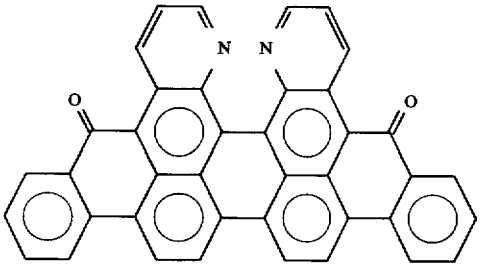

-continued
No. 4-36
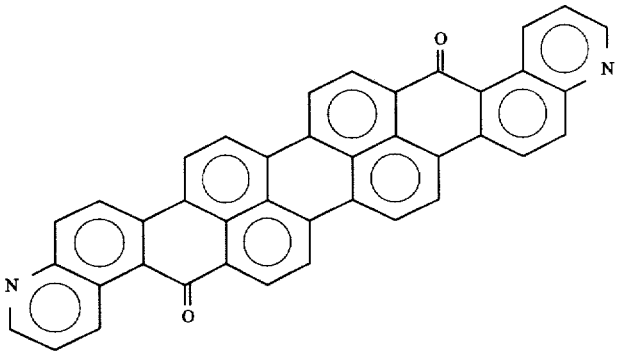
No. 4-37
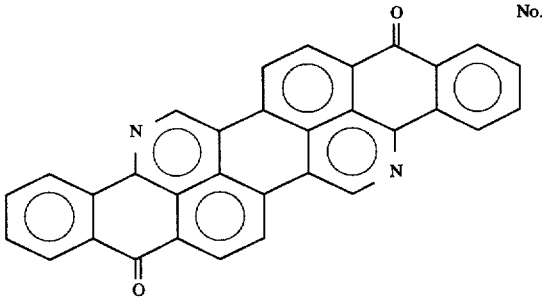
No. 4-38
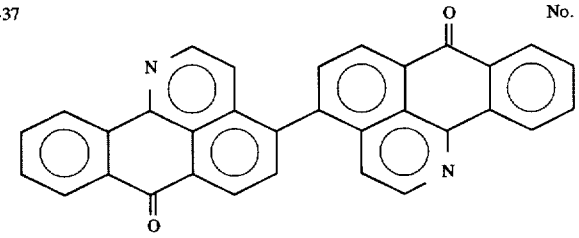
No. 4-39
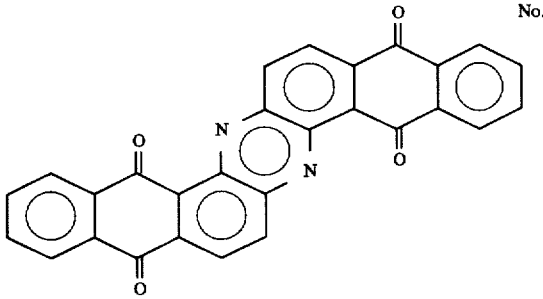
No. 4-40
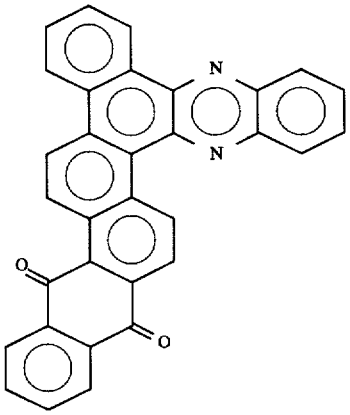
No. 4-41
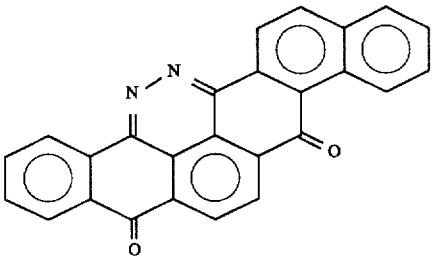
(Specific examples of diimidazole naphthalene tetracarboxylate pigment)
No. 5-1
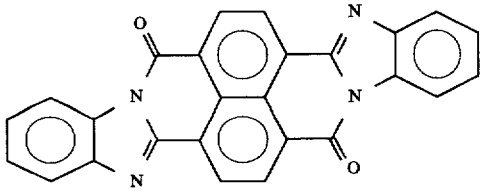
No. 5-2
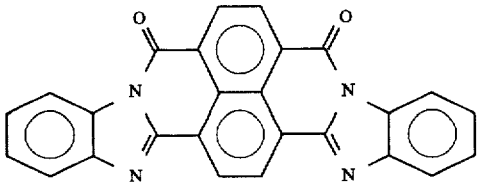

-continued

No. 5-3

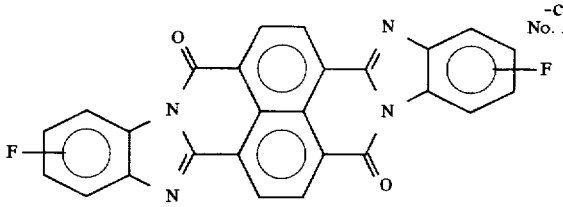

No. 5-4

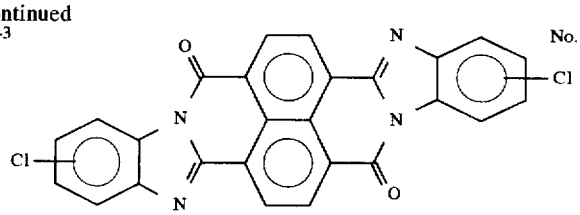

No. 5-5

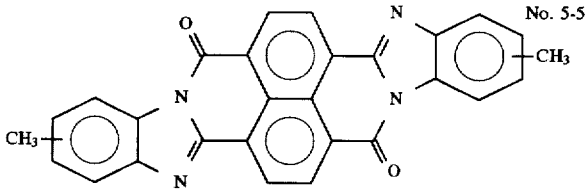

No. 5-6

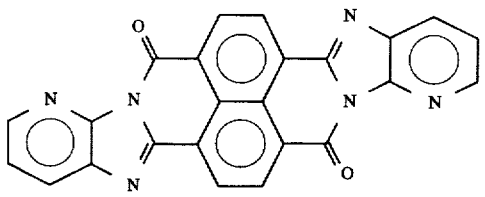

No. 5-7

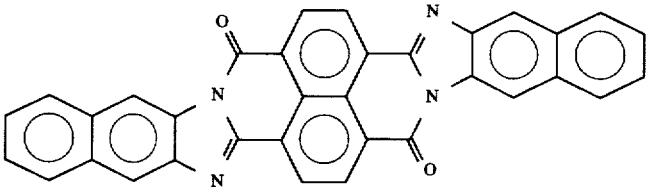

No. 5-8

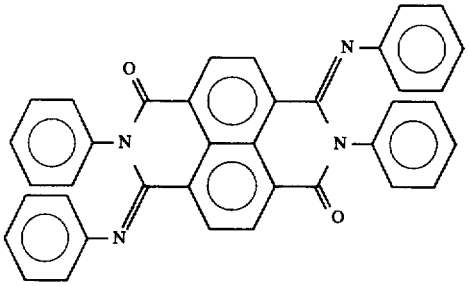

No. 5-9

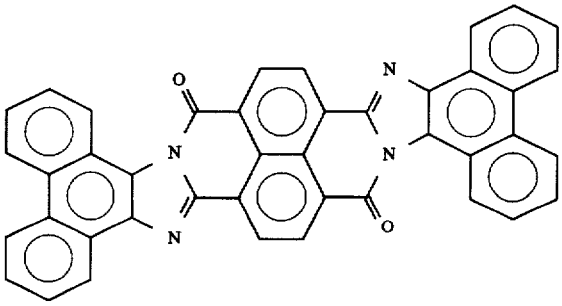

Examples of the electron-transporting material to be incorporated in the undercoat layer of the present invention further include quinones such as 2,5-dihydroxy-p-quinone; anthraquinones such as 1,2-dihydroxyanthraquinone, 1,5-dihydroxyanthraquinone, 1,8-dihydroxyanthraquinone, 1-aminoanthraquinone, anthraquinone-2,2-dicarboxylic acid, nitroanthraquinone, dinitroanthraquinone, quinizarin and 2,3-dihydroxyquinizarin; naphthoquinones such as 2,6-naphthoquinone, 2-hydroxy-1,4-naphthoquinone and 5,8-dihydroxy-1,4-naphthoquinone, benzoquinone such as o-benzoquinone, p-benzoquinone, methoxybenzoquinone, 2,3-dimethoxy-5-methyl-1,4-benzoquinone, 2,3-dichloro-5,6-dicyano-p-benzoquinone and quinhydrone; pyrimidines such as 4,6-dihydroxypyrimidine; diphenoquinones such as 3,3',5,5'-tetra-tert-butyl-4,4'-diphenoquinone, 3,5'-di-tert-butyl-3',5-diphenyl-4,4'diphenoquinone, 3,5-dimethyl-3',5-di-tert-butyl-4,4'diphenoquinone, 3,5'-diphenyl-3',5-di-tert-butyl-4,4'diphenoquinone, 3,5-dimethoxy-3',5'-di-tert-butyl-4,4'diphenoquinone, 3,3',5,5'-tetra-t-butyl-4,4'-diphenoquinone, 3,5'-bis(α,α,γ,γ-tetramethylbutyl)-3',5-di(α-methylpropyl)-4,4'-diphenoquinone, 3,5-bis(α,α,γ,γ-tetramethylbutyl)-3',5-di(α-methylpropyl)-4,4'-diphenoquinone, 3,5'-bis(α,α,γ,γ-tetramethylbutyl)-3',5-diphenyl-4,4'-diphenoquinone, 3,5'bis(α,γ-dimethylbutyl)-3',5-diphenyl-4,4'-diphenoquinone, 3,5'bis(α-dimethylbenzyl)-3',5-di(α-methylpropyl)-4,4'-diphenoquinone, 3,5-bis(α-dimethylbenzyl)-3',5'-di(α-methylpropyl)-4,4'-diphenoquinone,3,5'-bis(α-dimethylbenzyl)-3',5-dimethyl-4,4'-diphenoquinone, 3,5-bis(α-dimethylbenzyl)3',5'-dimethyl-4,4'-diphenoquinone, 3,5-dimethoxy-3',5'-di-tert-butyl-4,4'-diphenoquinone, 3,3'-dimethoxy-5,5'-di-tert-butyl-4,4'-diphenoquinone, 3,5-diethoxy-3',5'-di-tert-butyl-4,4'-diphenoquinone and 3,3'-diethoxy-5,5'-di-tert-butyl-4,4'-diphenoquinone; fluorenones such as 2,4,7-trinitro-9-fluorenone (TNF), 2,4,5,7-tetranitro-9-fluorenone, 2,4,7-trinitro-9-dicyanomethylenefluorenone, 2-(1,1-dimethoxybutyl)-4,5,7-trinitro-9-fluorenone and 2-hydroxy-9-fluorenone; xanthones such as 2,4,5,7-tetranitroxanthone and 2,4,9-trinitrothioxanthone; 4-(butoxycarbonyl)-9-dicyanomethylenefluorenone; anthraquinonedimethanes such as tetracyanoethylene, 7,7,8,8-tetracyanoquinodimethane, tetracyanoquinodimethane and 11,11-dicyano-12,12-bis(ethoxycarbonyl) anthraquinodimethane; dinitrobenzene, dinitroanthracene, dinitroacrydine, chloranyl, chloranylic acid, bromanyl, and 2,6-di-tert-butyl-4-dicyanomethylene-4-H-thiopyrane-1,1-dioxide. Among these electron-transporting materials, diphenoquinone has a high charge-transporting capacity in particular, making it possible to lower residual potential.

If the electron-transporting material has one or more hydrolyzable polymerizable substituent in its structure, a coat layer having a higher curability can be formed. Examples of the hydrolyzable polymerizable group include alkoxyl group such as methoxy group, ethoxy group, propoxy group, isopropoxy group, butoxy group, t-butoxy group and hexyloxy group, and hydroxyl group.

Among these electron-transporting materials, fluorenone compound, diphenoquinone compound and anthraquinodimethane compound have an excellent charge-transporting capacity and thus can provide desirable properties.

Further, the undercoat layer of the present invention comprises either or both of an organic metal compound and a silane coupling agent incorporated therein in combination with the foregoing electron-transporting material. These compounds may be used singly or in the form of mixture of polycondensate thereof. In particular, an organic compound or silane coupling agent having zirconium exhibits excellent properties, i.e., a high film-forming capacity, a low residual potential, little potential change due to environmental change and little potential change after repeated used.

Examples of the organic metal compound employable in the present invention include organic metal compounds containing zirconium, titanium, aluminum, manganese, etc. Specific examples of these organic metal compounds will be given below.

Examples of the organic zirconium compound include zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, zirconium methacrylate butoxide, zirconium stearate butoxide, and zirconium isostearate butoxide.

Examples of the organic titanium compound include tetraisopropyl titanate, tetranormal butyl titanate, butyl titanate dimer, tetra(2-ethylhexyl) titanate, titanium acetyl acetonate, polytitanium acetyl acetonate, titanium octylene glycolate, titanium lactate ammonium salt, titanium lactate, titanium lactate ethyl ester, titanium triethanol aminate, and polyhydroxy titanium stearate.

Examples of the organic aluminum compound include aluminum isopropylate, monobutoxy aluminum diisopropylate, aluminum butylate, diethyl acetoacetate aluminum diisopropylate, and aluminum tris (ethylacetoacetate).

Examples of the organic manganium compound include manganium methoxide and manganium 2,4-pentanedionate.

These exemplified organic metal compounds containing zirconium, titanium, aluminum and silicon are hydrolytically condensable compounds which can be moistened during the curing step to provide a coat layer which is cured further. In particular, an organic zirconium compound can provide a photoreceptor which provides little image defect.

Examples of the silane coupling agent include vinyl trimethoxysilane, vinyl triethoxysilane, vinyl tris(β-methoxyethoxysilane), γ-methacryloxypropyl trimethoxysilane, γ-methacryloxypropyl-tris(β-methoxyethoxy)silane, γ-glycidoxypropyl trimethoxysilane, vinyl triacetoxysilane, β-(3,4-epoxycyclohexyl) ethyltrimethoxysilane, γ-aminopropyl triethoxysilane, N-β-(aminoethyl)-γ-aminopropyl trimethoxysilane, N-β-(aminoethyl)-γ-(aminoethyl)-γ-aminopropylmethyl dimethoxysilane, N,N-bis(β-hydroxyethyl)-γ-aminopropyl triethoxysilane, N-phenyl-γ-aminopropyl trimethoxysilane, γ-mercaptopropyl trimethoxysilane, and γ-chloropropyl trimethoxysilane. Particularly preferred among these silane compounds are vinyl triethoxysilane, vinyl tris(β-methoxyethoxy) silane, γ-methacryloxypropyl trimethoxysilane, γ-glycidoxypropyl trimethoxysilane, β-(3,4-epoxycyclohexyl)ethyl trimethoxysilane, γ-aminopropyl triethoxysilane, N-β-(aminoethyl)-γ-aminopropyl trimethoxysilane, N-β-(aminoethyl)γ-aminopropylmethyl dimethoxysilane, N-phenyl-γ-aminopropyl trimethoxysilane, γ-mercaptopropyl trimethoxysilane and γ-chloropropyl trimethoxysilane. In particular, a silane coupling agent containing an amino group can provide a photoreceptor which gives little image defect.

The mixing proportion of the electron-transporting material is from 0.1 to 98% by weight, preferably from 5 to 90% by weight, more preferably from 10 to 50% by weight based on the total amount of the electron-transporting material, organic metal compound and silane coupling agent.

Examples of the binder resin other than the above copolymer resin having a hydrolyzable silyl group to be incorporated in the undercoat layer include high molecular compound such as acetal resin (e.g., polyvinyl butyral), polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin and melamine resin. The amount of the binder resin to be used is from 1 to 95% by weight, preferably from 5 to 90% by weight, more preferably from 5 to 30% by weight based on the total solid content in the undercoat layer.

The undercoat layer may comprise various organic or inorganic material powder incorporated therein for the purpose of inhibiting interference band or enhancing electrical properties. In particular, a white pigment such as titanium oxide, zinc oxide, zinc sulfide, white lead and lithopone, extender pigment such as alumina, calcium carbonate and barium sulfate, particulate teflon resin, particulate benzoguanamine resin, particulate styrene resin, etc. are useful. Such a powder may be incorporated in the undercoat layer in an amount of up to 90% by weight, preferably 1 to 80% by weight, more preferably 5 to 70% by weight, most preferably 30 to 60% by weight, based on the total solid content in the undercoat layer.

The particle diameter of the powder to be incorporated in the undercoat layer is properly predetermined, but it is preferably from 0.01 to 3 μm, more preferably 0.01 to 2 μm, most preferably 0.05 to 1 μm. If the particle diameter of the powder is too large, the resulting undercoat layer has too great an unevenness and too great an electrically partial nonuniformity and thus can give image defects. On the contrary, if the particle diameter of the powder is too small, a sufficient light scattering effect cannot be obtained.

In the preparation of the undercoat layer coating solution, the electron-transporting material and other particulate materials are added to and dispersed in a liquid containing resin components. The dispersion treatment can be accomplished by means of roll mill, ball mill, oscillating ball mill, attritor, sand mill, colloid mill, paint shaker or the like.

The formation of the undercoat layer, if a drum photoreceptor is prepared, can be accomplished by spray coating method, ring coating method, dip coating method or the like. If a belt-like photoreceptor is prepared, it is accomplished by spray coating method, bead coating method, curtain coating method, slot coating method or the like.

The greater the thickness of the undercoat layer is, the higher is the effect of opacifying the unevenness of the support. Thus, the greater the thickness of the undercoat layer is, the less is the occurrence of image defects, but the worse is the electrical repetition stability. Therefore, the thickness of the undercoat layer is preferably from 0.1 to 5 μm. However, if the undercoat layer comprises an electron-transporting organic pigment incorporated therein, it exhibits a reduced deterioration of electrical characteristics even when it has an increased thickness. Thus, the thickness of the undercoat layer can be predetermined to 10 μm at maximum. Further, the greater the thickness of the undercoat layer is, the less occurs leakage in a charging system liable to current leakage such as contact charging system. Accordingly, in the present invention, the thickness of the undercoat layer, if it comprises an electron-transporting organic pigment incorporated therein, can be predetermined to a range of from 2 to 10 μm.

The undercoat layer of the present invention which has been applied to the support may be subjected to drying and curing to form a rigid cured film which cannot be dissolved when coated with a upper layer coating solution. The drying and curing of the undercoat layer is normally effected at a temperature of from 40° C. to 200° C. for 3 minutes to 8 hours. When the reaction of the hydrolyzable reactive group to be used in the present invention is effected more vigorously, better electrical stability and image quality can be obtained. In order to allow the hydrolysis reaction to proceed more securely, drying may be accompanied by moistening. Moistening may be carried out by blowing wet hot air against the surface of the coat layer. The temperature of the wet hot air to be used herein is preferably from 30° C. to 180° C.

The charge-generating layer to be formed on the foregoing undercoat layer may be formed by vacuum-evaporating a charge-generating material onto the undercoat layer or by applying a dispersion of a charge-generating material with a binder resin in an organic solvent to the undercoat layer.

As the charge-generating material there may be used an inorganic photoconductive material such as amorphous selenium, crystalline selenium, selenium-tellurium alloy, selenium-arsenic alloy, other selenium compounds and alloys, zinc oxide and titanium oxide, phthalocyanine pigment such as metal-free phthalocyanine, titanyl phthalocyanine, copper phthalocyanine, tin phthalocyanine and gallium phthalocyanine, and organic pigment and dye such as squarium, anthanthrone, perylene, azo, anthraquinone, pyrene, pyrilium salt and thiapyrilium salt. These organic pigments normally occur in several crystal forms. In particular, phthalocyanine pigments are known to occur in several crystal forms such as α and β forms. Any crystal forms may be used so far as the pigment can provide a sensitivity suitable for the purpose.

The charge-generating layer may comprise a silane coupling agent or organic metal alkoxide incorporated therein for the purpose of inhibiting the coagulation of charge-generating material, enhancing the dispersibility and electrical properties of charge-generating material and like purposes. In order to incorporate these additives in the charge-generating layer, the charge-generating material may be previously surface-treated with these additives, followed by dispersion. Alternatively, the silane coupling agent or organic metal alkoxide may be added to the coating solution of the charge-generating material.

Examples of the binder resin to be used in the charge-generating layer include bisphenol A type, bisphenol C type or bisphenol Z type polycarbonate resin, polyester resin, methacrylic resin, acrylic resin, polyvinyl chloride resin, polystyrene resin, polyvinyl acetate resin, styrene-butadiene copolymer resin, vinylidene chloride-acrylonitrile copolymer resin, vinyl chloride-vinyl acetate-maleic anhydride resin, silicone resin, silicone-alkyd resin, phenolformaldehyde resin, styrene-alkyd resin, and poly-N-vinylcarbazole. These binder resins may be used singly or in admixture.

The mixing ratio (by weight) of the charge-generating material to the binder resin is preferably from 10:1 to 1:10. The thickness of the charge-generating layer is normally from 0.01 to 5 μm, preferably from 0.05 to 2.0 μm.

The dispersion of the charge-generating material in the resin can be accomplished by means of roll mill, ball mill, oscillation mill, dinomill, oscillating ball mill, attritor, sand mill, colloid mill, or the like. Examples of the solvent to be used in the dispersion process include alcohol such as methanol, ethanol, propanol and n-butyl alcohol, ester such as ethyl acetate and butyl acetate, aromatic hydrocarbon such as toluene and xylene, and halogenated hydrocarbon such as methylene chloride and 1,2-dichloroethane.

On the charge-generating layer is provided a charge-transporting layer. The charge-transporting layer is made of a charge-transporting material and optionally a binder resin.

Examples of the charge-transporting material to be used in the charge-transporting layer include positive hole-transporting substance such as oxanediazole derivative (e.g., 2,5-bis(p-diethylaminophenyl)-1,3,4-oxadiazole), pyrazoline derivative (e.g.,1,3,5-triphenylpyrazoline, 1-[pyridyl-(2)]-3-(p-diethylamiostyryl)-5-(p-diethylaminostyryl) pyrazoline), aromatic tertiary amino compound (e.g., triphenylamine, tri(p-methyl)phenylamine, N,N-bis(3,4-dimethylphenyl)biphenyl-4-amine, dibenzylaniline), aromatic tertiary diamino compound (e.g., N,N'-diphenyl-N,N'-bis(3-methylphenyl)-[1,1-biphenyl]4,4'-diamine), 1,2,4-triazine derivative (e.g., 3-(4'-dimethylaminophenyl)-5,6-di-(4'-methoxyphenyl)-1,2,4-triazine), hydrazone derivative (e.g., 4-diethylaminobenzaldeyde-1,1-diphenylhydrazone), quinazoline derivative (e.g., 2-phenyl-4-styrylquinazoline), benzofuran derivative (e.g., 6-hydroxy-2,3-di(p-methoxyphenyl) benzofuran), α-stilbene derivative (e.g., p-(2,2-diphenylvinyl)-N,N-diphenylaniline), enamine derivative, carbazole derivative (e.g., N-ethylcarbazole), poly-N-vinylcarbazole and derivative thereof, electron-transporting substance such as quinone compound (e.g., chloranyl, bromoanyl, anthraquinone), tetracyanoquinodimethane compound, fluorenone compound (e.g., 2,4,7-trinitrofluorenone, 2,4,5,7-tetranitro-9-fluorenone), xanthone compound, thiophene compound and diphenoquinone compound, and polymer having groups made of the foregoing compounds in its main or side chains. These charge-transporting materials may be used singly or in combination.

Examples of the binder resin to be used in the charge-transporting layer include insulating resin such as acrylic resin, polyacrylate, polyester resin, bisphenol A type, bisphenol C type or bisphenol Z type polycarbonate resin, polystyrene, acrylonitrile-styrene copolymer, acrylonitrile-butadiene copolymer, polyvinyl butyral, polyvinyl formal, polysulfone, polyacrylamide, polyamide and chlorinated rubber, and organic photoconductive polymer such as polyvinyl carbazole, polyvinyl anthracene and polyvinyl pyrene.

The formation of the charge-transporting layer may be formed by applying a solution of the foregoing charge-transporting material and binder resin in a proper solvent to the undercoat layer which is then dried. Examples of the solvent to be used in the formation of the charge-transporting layer include aromatic hydrocarbon such as benzene, toluene and chlorobenzene, ketone such as acetone and 2-butanone, halogenated aliphatic hydrocarbon such as methylene chloride, chloroform and ethylene chloride, cyclic or straight-chain ether such as tetrahydrofuran, dioxane, ethylene glycol and diethyl ether, and mixture thereof. The mixing ratio of the charge-transporting material to the foregoing binder resin is preferably from 10:1 to 1:5.

For the purpose of inhibiting the deterioration of the photoreceptor by ozone or oxidizing gas generated in the electrophotographic apparatus or light or heat, the charge-transporting layer may comprise additives such as oxidation inhibitor, light stabilizer and heat stabilizer incorporated therein.

Examples of the oxidation inhibitor include hindered phenol, hindered amine, paraphenylenediamine, arylalkane, hydroquinone, spirochromane, spiroindanone, derivative thereof, organic sulfur compound, and organic phosphorus compound.

Examples of the light stabilizer include derivative such as benzophenone, benzotriazole, dithiocarbamate and tetramethyl piperidine.

Further, the charge-transporting layer may comprise at least one electron-receptive substance incorporated therein for the purpose of enhancing sensitivity, reducing residual potential and reducing fatigue upon repeated use. Examples of the electron-receptive substance which can be incorporated in the electrophotographic photoreceptor of the present invention include succinic anhydride, maleic anhydride, phthalic anhydride, tetrabromophthalic anhydride, tetracyanoethylene, tetracyanoquinodimethane, o-dinitrobenzene, m-dinitrobenzene, chloranyl, dinitroanthraquinone, trinitrofluorenone, picric acid, o-nitrobenzoic acid, p-nitrobenzoic acid, and phthalic acid. Particularly preferred among these electron-receptive substances are fluorenone, quinone, and benzene derivative having an electrophilic substituent such as Cl, CN and $NO_2$.

The coating of the charge-transporting layer can be accomplished by dip coating method, spray coating method, bead coating method, blade coating method, roller coating method or the like. The heating and drying of the coating solution is preferably effected at a temperature of from 30° C. to 200° C. for 5 minutes to 2 hours. The thickness of the charge-transporting layer is normally predetermined to a range of from 5 to 50 μm, preferably from 10 to 40 μm.

A surface protective layer may be formed on the charge-transporting layer as necessary. An example of the surface protective layer is an insulating resin protective layer or a low resistivity protective layer having a resistivity adjustor incorporated in an insulating resin. An example of the low resistivity protective layer is a layer having a particulate electrically-conductive material dispersed in an insulating resin. As the particulate electrically-conductive material there may be properly used a white, gray or white blue particulate material, having an electrical resistance of not higher than $10^9$ Ω·cm and an average particle diameter of not more than 0.3 μm, preferably not more than 0.1 μm. Examples of the particulate electrically-conductive material include molybdenum oxide, tungsten oxide, antimony oxide, tin oxide, titanium oxide, indium oxide, solid solution or mixture of tin oxide with antimony or antimony oxide, mixture of single particulate material with these metal oxides, and single particulate material coated with these metal oxides. Preferred among particulate electrically-conductive materials are tin oxide and solid solution of tin oxide with antimony or antimony oxide, which allow proper adjustment of electrical resistance and can render the protective layer substantially transparent (see JP-A-57-30847, JP-A-57-128344). Examples of the insulating resin include condensed resin such as polyamide, polyurethane, polyester, epoxy resin, polyketone and polycarbonate, and vinyl polymer such as polyvinyl ketone, polystyrene and polyacrylamide.

The electrophotographic photoreceptor of the present invention can be used in electrophotographic apparatus such as light lens system copying machine, laser beam printer emitting near infrared light or visible light, digital copying machine, LED printer and laser facsimile. The electrophotographic photoreceptor of the present invention may be applied to any of systems employing unitary and binary regular developers and reversal developer. Further, the electrophotographic photoreceptor of the present invention involves little current leakage and thus can provide good properties even in the contact-charging system employing a charging roller, charging brush or the like.

The image forming apparatus and process of the present invention will be described hereinafter.

The attached figure illustrates an example of an image forming apparatus employing the electrophotographic photoreceptor of the present invention. A charging apparatus 3 into which a voltage is supplied from a power supply 2 provided exterior to the apparatus is provided in contact with the surface of a photoreceptor drum 1. Provided around the photoreceptor drum 1 are an image inputting apparatus 4, a developing apparatus 5, a pressure transferring apparatus or electrostatic transferring apparatus 6, a cleaner mechanism 9, and a destacizer 10. Shown at the reference numerals 7 and 8 are paper and a fixing apparatus, respectively. In the image forming apparatus of the present invention, the charging apparatus is shown in the form of charging roll. However, the charging apparatus may be in the form of charging brush type or blade type film charging apparatus. A d.c. voltage is supplied into the charging apparatus from the power supply 2 provided exterior to the apparatus. In order to enhance the uniformity in charging, an a.c. voltage may be superposed on the d.c. voltage which is applied to the charging apparatus.

The image forming process of the present invention is effected as follows. In some detail, the surface of the photoreceptor drum 1 is charged by the charging apparatus 3 to which a d.c. voltage of normally from 50 to 2,000 V has been applied. For example, in the case of a system in which an electrically-conductive elastic roller is brought into contact with the surface of the photoreceptor, a d.c. voltage of about 1 to 2 kv maybe applied to the charging apparatus. The photoreceptor is then exposed to light from an optical, laser or LED image inputting apparatus 4 by which the original image is irradiated with light. Thus, an electrostatic latent image is formed. The electrostatic latent image thus formed is made visible with a toner by a developing apparatus 5 to turn to a toner image. In this case, development can be accomplished by a magnetic brush method. The toner image thus formed is transferred to paper 7 by the pressure transferring apparatus or electrostatic transferring apparatus 6, and then fixed by the fixing apparatus 8. On the other hand, the toner remaining on the surface of the photoreceptor drum 1 after transferring is removed by the cleaner mechanism 9 comprising a blade. Slight electrical charge which has remained on the surface of the photoreceptor drum 1 is eliminated by the destascizer 10.

The present invention will be further described in the following examples, but the present invention should not be construed as being limited thereto.

EXAMPLE 1

To 33 parts by weight of a copolymer resin containing a hydrolyzable silyl group (SA246, available from Sanyo Chemical Industries, Ltd.)(acryl copolymer resin base having a number-average molecular weight of 11,000 and a weight-average molecular weight of 34,000 made of three monomer components, i.e., methyl methacrylate, butyl acrylate and γ-methacryloxy propyl trimethoxysilane in a molar ratio of 38:35:27) were added 60 parts by weight of xylene. The mixture was then stirred. To the mixture were then added 39 parts by weight of the foregoing exemplified Compound No. 4-6 as an electron-transporting pigment. The mixture was then subjected to dispersion by a sandmill for 3 hours. To the mixture were then added 0.3 parts by weight of an organic tin compound catalyst (S-CAT. 24, available from Sankyo Yuki Gosei K.K.). The mixture was then stirred to prepare an undercoat layer-forming coating solution. The coating solution thus prepared was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 150° C. for 1 hour to prepare an undercoat layer having a thickness of 5 μm.

A mixture of 15 parts by weight of gallium chloride phthalocyanine as a charge-generating material, 10 parts by weight of a vinyl chloride-vinyl acetate copolymer resin (VMCH, available from Nippon Unicar Company Limited) and 30 parts by weight of n-butyl alcohol was subjected to dispersion by means of a sandmill for 4 hours. The dispersion thus obtained was applied to the foregoing undercoat layer by dip coating method, and then dried to form a charge-generating layer having a thickness of 0.2 μm. 4 parts by weight of N,N'-diphenyl-N,N'-bis (3-methylphenyl)-[1, 1'-biphenyl]-4,4'-diamine and 5 parts by weight of a bisphenol Z polycarbonate resin (molecular weight: 40,000) were dissolved in 80 parts by weight of chlorobenzene. The solution thus obtained was applied to the foregoing charge-generating layer, and then dried to form a charge-transporting layer having a thickness of 20 μm. Thus, an electrophotographic photoreceptor consisting of three layers was prepared.

The electrophotographic photoreceptor thus obtained was then mounted on a contact-charging process printer (PC-PR1000/4R, available from NEC Corp.) for copying operation. The results of residual potential on the electrophotographic photoreceptor and image quality thus obtained are set forth in Table 1.

The confirmation of electron-transporting properties was conducted as follows.

In Example 1, a drum comprising an undercoat layer and a charge-generating layer of the present invention formed on an electrically-conductive substrate was prepared. The drum was charged to −200 V by means of a scorotron, and then irradiated with light having a wavelength of 780 nm to excite photo carrier in the charge-generating layer. The resulting light decay was 10 $V \cdot m^2/mJ$. On the other hand, the same drum was charged to +200 V, and then irradiated with light in the same manner as above. As a result, no light decay was observed. Accordingly, the exemplified Compound NO. 4-6 incorporated in the undercoat layer of the present invention was confirmed to be an electron-transporting pigment.

COMPARATIVE EXAMPLE 1

To 33 parts by weight of a copolymer resin containing a hydrolyzable silyl group (SA246, available from Sanyo Chemical Industries, Ltd.)(acryl copolymer resin base having a number-average molecular weight of 11,000 and a weight-average molecular weight of 34,000 made of three monomer components, i.e., methyl methacrylate, butyl acrylate and γ-methacryloxy propyl trimethoxysilane in a molar ratio of 38:35:27) were added 40 parts by weight of xylene. To the solution was not added the electron-transporting pigment as in Example 1. To the solution were added 0.3 parts by weight of an organic tin compound catalyst (S-CAT. 24, available from Sankyo Yuki Gosei K.K.). The mixture was then stirred to obtain a coating solution. The coating solution thus prepared was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 150° C. for 1 hour to prepare an undercoat layer having a thickness of 5 μm.

An undercoat layer, a charge-generating layer and a charge-transporting layer were then formed sequentially in the same manner as in Example 1 to prepare an electrophotographic photoreceptor. The electrophotographic photoreceptor thus obtained was then evaluated in the same manner as in Example 1. The results are set forth in Table 1.

TABLE 1

| Example No. | Residual potential (V) | Environmental change of residual potential (V) | Image quality |
|---|---|---|---|
| Example 1 | −48 | 50 | No problem |
| Comparative Example 1 | −360 | 620 | No image obtained |

To 33 parts by weight of the copolymer resin containing a hydrolyzable silyl group (SA246, available from Sanyo Chemical Industries, Ltd.) were added 60 parts by weight of xylene. To the solution thus obtained were then added 60 parts by weight of the foregoing exemplified Compound No. 2-1 as an electron-transporting pigment. The mixture was then subjected to dispersion by means of a ball mill for 20 hours. The dispersion thus obtained was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 170° C. for 1 hour to prepare an undercoat layer having a thickness of 4 μm.

A mixture of 15 parts by weight of hydroxy gallium phthalocyanine as a charge-generating material, 10 parts by weight of a polyvinyl butyral resin (S-LEC BM-S, available from Sekisui Chemical Co., Ltd.) and 30 parts by weight of n-butyl alcohol was subjected to dispersion by means of a sandmill for 4 hours. The dispersion thus obtained was applied to the foregoing undercoat layer by dip coating method, and then dried to form a charge-generating layer having a thickness of 0.2 μm. 4 parts by weight of N,N'-bis (3,4-dimethylphenyl)biphenyl-4-amine and 6 parts by weight of a bisphenol Z polycarbonate resin (molecular weight: 40,000) were dissolved in 80 parts by weight of chlorobenzene. The solution thus obtained was applied to the foregoing charge-generating layer, and then dried to form a charge-transporting layer having a thickness of 20 μm. Thus, an electrophotographic photoreceptor consisting of three layers was prepared.

The electrophotographic photoreceptor thus obtained was then mounted on a contact-charging process printer (PC-PR1000/4R, available from NEC Corp.) for copying operation. The results of residual potential on the electrophotographic photoreceptor and image quality thus obtained are set forth in Table 2.

EXAMPLES 3 and 4

The procedure of Example 2 was followed to form an undercoat layer except that the proportion (molar ratio) of monomer components, i.e., methyl methacrylate, butyl acrylate and γ-methacryloxypropyl trimethoxysilane in the acrylic resin containing a hydrolyzable silyl group was changed to 25:23:52 (Example 3) and 46:43:11 (Example 4). A charge-generating layer and a charge-transporting layer were then formed in this order on the undercoat layer in the same manner as in Example 2.

The electron photoreceptor thus obtained was then subjected to copying operation and evaluation in the same manner as in Example 2. The results are set forth in Table 2.

EXAMPLE 5

50 parts by weight of $CF_3(CF_2)_5(CH_2)_2OCOCH{=}CH_2$, 47 parts by weight of n-butyl acrylate and 3 parts by weight of γ-mercaptopropyl trimethoxysilane were subjected to copolymerization in xylene in the presence of azobisisobutylonitrile as a radical polymerization initiator to synthesize a copolymer resin. Using this resin, an undercoat layer was then formed in the same manner as in Example 2. A charge-generating layer and a charge-transporting layer were then sequentially formed on the undercoat layer in the same manner as in Example 2.

The electrophotographic photoreceptor thus obtained was then subjected to copying operation and evaluation in the same manner as in Example. 2. The results are set forth in Table 2.

COMPARATIVE EXAMPLE 2

To 33 parts by weight of a copolymer resin containing a hydrolyzable silyl group (SA246, available from Sanyo Chemical Industries, Ltd.) were added 60 parts by weight of xylene as in Example 2. The solution thus obtained was processed in the same manner as in Example 2 except that the electron-transporting pigment was not added as in Example 2 to prepare a coating solution. The coating solution thus prepared was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 170° C. for 1 hour to prepare an undercoat layer having a thickness of 4.8 μm. A charge-generating layer and a charge-transporting layer were then formed sequentially in the same manner as in Example 2.

The electrophotographic photoreceptor thus obtained was then subjected to copying operation and evaluation in the same manner as in Example 2. The results are set forth in Table 2.

COMPARATIVE EXAMPLE 3

The procedure of Example 2 was followed except that 18 parts by weight of a polyamide resin (Luckamide 5003, available from Dainippon Ink & Chemicals, Inc.) were used instead of the acrylic resin containing a hydrolyzable silyl group to be incorporated in the undercoat layer and mixed with a solvent made of 17 parts by weight of methanol and 17 parts by weight of water. To the solution thus obtained were then added 60 parts by weight of the foregoing exemplified Compound No. 2-1 as an electron-transporting pigment. The mixture was then subjected to dispersion by means of a ballmill for 20 hours. The dispersion thus obtained was then applied to a 30 mmϕ ED pipe aluminum substrate which had been subjected to liquid honing to have a roughened surface having Ra of 0.18 μm by means of a ring coating apparatus. The coated material was then subjected to drying and curing at a temperature of 150° C. for 30 minutes to prepare an undercoat layer having a thickness of 4.1 μm. A charge-generating layer and a charge-transporting layer were then formed sequentially in the same manner as in Example 2.

The electrophotographic photoreceptor thus obtained was then subjected to copying operation and evaluation in the same manner as in Example 2. The results are set forth in Table 2.

COMPARATIVE EXAMPLE 4

The procedure of Example 2 was followed except that 18 parts by weight of a methyl methacrylate resin (Elvacite 2021, available from Du Pont K.K.) were used instead of the acrylic resin containing a hydrolyzable silyl group to be incorporated in the undercoat layer and mixed with 34 parts by weight of xylene. To the solution thus obtained were then added 60 parts by weight of the foregoing exemplified Compound No. 2-1 as an electron-transporting pigment. The mixture was then subjected to dispersion by means of a ballmill for 20 hours. The dispersion thus obtained was then applied to a 30 mmϕ ED pipe aluminum substrate which had been subjected to liquid honing to have a roughened surface having Ra of 0.18 μm by means of a ring coating apparatus. The coated material was then subjected to drying and curing at a temperature of 150° C. for 30 minutes to prepare an undercoat layer having a thickness of 4.1 μm. On the undercoat layer was then formed a charge-generating layer as in Example 2. However, the undercoat layer was dissolved, giving a coat layer having remarkable coat defects. Thus, the desirable photoreceptor could not be formed.

EXAMPLE 6

To 33 parts by weight of a copolymer resin containing a hydrolyzable silyl group (acryl copolymer resin base having a number-average molecular weight of 11,000 and a weight-average molecular weight of 34,000 made of three monomer components, i.e., methyl methacrylate, butyl acrylate and γ-methacryloxy propyl trimethoxysilane in a molar ratio of 25:23:52) were added 25 parts by weight of xylene. To the solution thus obtained were then added 30 parts by weight of the foregoing exemplified Compound No. 4-6 as an electron-transporting pigment. The mixture was then subjected to dispersion by means of a sand mill for 3 hours. To the dispersion were then added 5 parts by weight of zirconium acetyl acetonate tetrabutoxide (ZC540, available from Matsumoto Seiyaku K.K.). The coating solution thus obtained was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 170° C. for 1 hour to prepare an undercoat layer having a thickness of 5.3 μm. A charge-generating layer and a charge-transporting layer were then formed sequentially in the same manner as in Example 2.

The electrophotographic photoreceptor thus obtained was then subjected to copying operation and evaluation in the same manner as in Example 2. The results are set forth in Table 2.

EXAMPLE 7

To 33 parts by weight of a copolymer resin containing a hydrolyzable silyl group as used in Example 1 (SA246, available from Sanyo Chemical Industries, Ltd.) were added 25 parts by weight of xylene. To the solution thus obtained were then added 39 parts by weight of the foregoing exemplified Compound No. 4-5 as an electron-transporting pigment. The mixture was then subjected to dispersion by means of a sand mill for 3 hours. The dispersion thus obtained were then mixed with 30 parts by weight of γ-aminopropyl triethoxysilane (A100, available from Nippon Unicar Company Limited). The coating solution thus obtained was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 170° C. for 1 hour to prepare an undercoat layer having a thickness of 5.3 μm. A charge-generating layer and a charge-transporting layer were then formed sequentially in the same manner as in Example 2.

The electrophotographic photoreceptor thus obtained was then subjected to copying operation and evaluation in the same manner as in Example 2. The results are set forth in Table 2.

TABLE 2

| Example No. | Residual potential (V) | Environmental change of residual potential (V) | Image quality |
|---|---|---|---|
| Example 2 | −55 | 51 | No problem |
| Example 3 | −71 | 50 | No problem |
| Example 4 | −60 | 48 | No problem |
| Example 5 | −59 | 55 | No problem |
| Comparative Example 2 | −361 | 500 | No image obtained |
| Comparative Example 3 | −480 | 530 | No image obtained |

TABLE 2-continued

| Example No. | Residual potential (V) | Environmental change of residual potential (V) | Image quality |
|---|---|---|---|
| Example 6 | −47 | 49 | No problem |
| Example 7 | −49 | 51 | No problem |

EXAMPLES 8–12 and COMPARATIVE EXAMPLES 5–7

To 33 parts by weight of a copolymer resin containing a hydrolyzable silyl group as used in Example 1 (SA246, available from Sanyo Chemical Industries, Ltd.) were added 25 parts by weight of xylene. To the solution thus obtained were then added 39 parts by weight of each of the organic pigments set forth in Table 3 as an electron-transporting pigment. The mixture was then subjected to dispersion by means of a sand mill for 3 hours. The organic pigments used in Examples 8 to 12 were electron-transporting organic pigments while those used in Comparative Examples 5 to 7 were positive hole-transporting pigments. The dispersion thus obtained were then applied to a 30 mmϕ ED pipe aluminum substrate which had been subjected to liquid honing to have a roughened surface having Ra of 0.18 μm by means of a ring coating apparatus. The coated material was then subjected to curing at a temperature of 170° C. for 1 hour to prepare an undercoat layer having a thickness of 5 μm. A charge-generating layer and a charge-transporting layer were then formed sequentially in the same manner as in Example 2.

The electrophotographic photoreceptor thus obtained was then subjected to copying operation and evaluation in the same manner as in Example 2. The results are set forth in Table 3.

TABLE 3

| Example No. | Organic pigment | Residual potential (V) | Environmental change of residual potential (V) | Image quality |
|---|---|---|---|---|
| Example 8 | Compound 1-5 | −51 | 48 | No problem |
| Example 9 | Compound 1-6 | −58 | 48 | No problem |
| Example 10 | Compound 1-8 | −63 | 51 | No problem |
| Example 11 | Compound 2-5 | −59 | 46 | No problem |
| Example 12 | Compound 3-21 | −73 | 53 | N0 problem |
| Comparative Example 5 | Magnesium phthalocyanine | −80 | 81 | Current leakage to charging roll; striped image defect |
| Comparative Example 6 | Hydroxy squarium | −41 | 123 | Current leakage to charging roll; striped image defect |
| Comparative Example 7 | Iron phthalocyanine | −50 | 67 | Current leakage to charging roll; striped image defect |

EXAMPLE 13

To 33 parts by weight of a copolymer resin containing a hydrolyzable silyl group as used in Example 1 (SA246, available from Sanyo Chemical Industries, Ltd.) were added 60 parts by weight of xylene. To the solution thus obtained were then added 39 parts by weight of the foregoing exemplified Compound No. 4-6 as an electron-transporting pigment. The mixture was then subjected to dispersion by means of a sand mill for 3 hours. To the dispersion thus obtained were then added 0.3 parts by weight of an organic tin compound catalyst (S-CAT. 24, available from Sankyo Yuki Gosei K.K.). The mixture was then stirred to obtain an undercoat layer-forming coating solution. The coating solution thus obtained were then applied to a 30 mmϕ ED pipe aluminum substrate which had been subjected to liquid honing to have a roughened surface having Ra of 0.18 μm by means of a ring coating apparatus. The coated material was then subjected to curing at a temperature of 150° C. for 1 hour to prepare undercoat layers having a thickness of 1, 3, 5 and 8 μm.

A mixture of 15 parts by weight of gallium chloride phthalocyanine as a charge-generating material, 10 parts by weight of a vinyl chloride-vinyl acetate copolymer resin (VMCH, available from Nippon Unicar Company Limited) and 300 parts by weight of n-butyl alcohol was subjected to dispersion by means of a sandmill for 4 hours. The dispersion thus obtained was applied to the foregoing undercoat layer by dip coating method, and then dried to form a charge-generating layer having a thickness of 0.2 μm. 4 parts by weight of N,N-bis(3,4-dimethylphenyl)biphenyl-4-amine and 6 parts by weight of a bisphenol Z polycarbonate resin (molecular weight: 40,000) were dissolved in 80 parts by weight of chlorobenzene. The solution thus obtained was applied to the foregoing charge-generating layer, and then dried to form a charge-transporting layer having a thickness of 20 μm. Thus, an electrophotographic photoreceptor consisting of three layers was prepared.

The electrophotographic photoreceptor thus obtained was then subjected to copying operation and evaluation in the same manner as in Example 1. The results are set forth in Table 4.

COMPARATIVE EXAMPLE 8

To 33 parts by weight of a copolymer resin containing a hydrolyzable silyl group (SA246, available from Sanyo Chemical Industries, Ltd.) were added 50 parts by weight of xylene as in Example 1. To the solution thus obtained was not added any electron-transporting pigment. To the solution was added 0.3 parts by weight of an organic tin compound catalyst (S-CAT. 24, available from Sankyo Yuki Gosei K.K.). The mixture was then stirred to obtain an undercoat layer-forming coating solution. The coating solution thus obtained was then applied to a 30 mmϕ ED pipe aluminum substrate which had been subjected to liquid honing to have a roughened surface having Ra of 0.18 μm by means of a ring coating apparatus. The coated material was then subjected to curing at a temperature of 150° C. for 1 hour to prepare undercoat layers having a thickness of 1, 3, 5 and 8 μm.

A charge-generating layer and a charge-transporting layer were then formed on the undercoat layer as in Example 13 to prepare an electrophotographic photoreceptor consisting of three layers.

The electrophotographic photoreceptor thus obtained was then subjected to copying operation and evaluation in the same manner as in Example 1. The results are set forth in Table 4.

TABLE 4

| Example No. | Thickness of undercoat layer (μm) | Residual potential | Image quality |
|---|---|---|---|
| Example 13 | 1 | −65 | Some current leakage to charging roll |
| | 3 | −71 | Good |
| | 5 | −70 | Good |
| | 8 | −75 | Good |
| Comparative Example 8 | 1 | −61 | Current leakage to charging roll |
| | 3 | −126 | Fogged |
| | 5 | −380 | No image obtained |
| | 8 | −540 | No image obtained |

As shown in Table 4, the electrophotographic photoreceptors comprising an electron-transporting pigment of Example 13 were excellent in all the electrical properties even when the thickness of the undercoat layer was raised. On the contrary, the electrophotographic photoreceptors free of electron-transporting pigment of Comparative Example 8 showed a drastic rise in residual potential with the rise in the film thickness and thus could not provide any desirable image.

EXAMPLE 14

3 parts by weight of a polyvinyl butyral resin (S-LEC BM-S, available from Sekisui Chemical Co., Ltd.) were dissolved in 10 parts by weight of toluene. 5 parts by weight of 3,3',5,5'-tetra-t-butyl-4,4'-diphenoquinone were then dissolved in the solution. To the solution were then added dropwise 40 parts by weight of a 50 wt-% solution of an organic zirconium compound (zirconium tetrabutyrate) with stirring. The solution was then filtered to obtain an undercoat layer-forming coating solution.

The coating solution thus obtained was then applied to a 30 mmϕ aluminum substrate which had been roughened by liquid honing by ring coating. The coated material was air-dried at room temperature for 5 minutes, and then dried and cured at a temperature of 170° C. for 10 minutes to form an undercoat layer having a thickness of 1 μm.

A mixture of 15 parts by weight of gallium chloride phthalocyanine as a charge-generating material, 10 parts by weight of a vinyl chloride-vinyl acetate copolymer resin (VMCH, available from Nipponi Unicar Company Limited) and 30 parts by weight of n-butyl alcohol was subjected to dispersion by means of a sandmill for 4 hours. The dispersion thus obtained was applied to the foregoing undercoat layer by dip coating method, and then dried to form a charge-generating layer having a thickness of 0.2 μm. 4 parts by weight of N,N'-diphenyl-N,N'-bis(3-methylphenyl)-[1,1'-biphenyl]-4,4'-diamine and 5 parts by weight of a bisphenol Z polycarbonate resin (molecular weight: 40,000) were dissolved in 80 parts by weight of chlorobenzene. The solution thus obtained was applied to the charge-generating layer, and then dried to form a charge-transporting layer having a thickness of 20 μm. Thus, an electrophotographic photoreceptor consisting of three layers was prepared.

Using an apparatus for evaluating electrical properties, the electrophotographic photoreceptor thus obtained was charged to −700 V, exposed to light at a predetermined exposure, and then measured for potential. The results are set forth in Table 5.

COMPARATIVE EXAMPLE 9

3 parts by weight of a polyvinyl butyral resin were dissolved in 10 parts by weight of toluene. To the solution were then added dropwise 43 parts by weight of a 50 wt-% toluene solution of an organic zirconium compound (zirconium tetrabutyrate) with stirring. The solution was then filtered to obtain an undercoat layer-forming coating solution. The coating solution thus obtained was then processed in the same manner as in Example 14 to prepare an electrophotographic photoreceptor comprising an undercoat layer, a charge-generating layer and a charge-transporting layer. The electrical properties of the electrophotographic photoreceptor thus obtained were evaluated. The results are set forth in Table 5.

COMPARATIVE EXAMPLE 10

3 parts by weight of a polyvinyl butyral resin were dissolved in 10 parts by weight of toluene. 5 parts by weight of 3,3',5,5'-tetra-t-butyl-4,4'-diphenoquinone were then dissolved in the solution. The solution was then filtered to obtain an undercoat layer-forming coating solution. The coating solution thus obtained was then processed in the same manner as in Example 14 to prepare an electrophotographic photoreceptor comprising an undercoat layer, a charge-generating layer and a charge-transporting layer. The electrical properties of the electrophotographic photoreceptor thus obtained were evaluated. The results are set forth in Table 5.

COMPARATIVE EXAMPLE 11

The procedure of Example 1 was followed except that the binder resin was changed to a resol phenol resin (Priophene J-325, available from Dainippon Ink & Chemicals, Inc.) in an amount of 3 parts by weight which was then dissolved in 10 parts by weight of n-butyl alcohol and 5 parts by weight of 3,3',5,5'-tetra-t-butyl-4,4'-diphenoquinone were dissolved in the solution free from any organic metal compound. The solution was then filtered to obtain an undercoat layer-forming coating solution. The coating solution thus obtained was then processed in the same manner as in Example 14 to prepare an electrophotographic photoreceptor comprising an undercoat layer, a charge-generating layer and a charge-transporting layer. The electrical properties of the electrophotographic photoreceptor thus obtained were evaluated. The results are set forth in Table 5.

TABLE 5

| Example No. | Charged potential | Surface potential after exposure at 2 mJ/m$^2$ (780 nm) | Residual potential |
|---|---|---|---|
| Example 14 | −700 V | −130 V | −50 V |
| Comparative Example 9 | −698 V | −170 V | −80 V |
| Comparative Example 10 | −697 V | −210 V | −110 V |
| Comparative Example 11 | −700 V | −365 V | −340 V |

EXAMPLE 15

3 parts by weight of a polyvinyl butyral resin (S-LEC BX-1, available from Sekisui Chemical Co., Ltd.) were dissolved in 10 parts by weight of cyclohexanone. 5 parts by weight of 2,3-dimethoxy-5-methyl-1,4-benzoquinone were then dissolved in the solution. To the solution thus obtained were added 42 parts by weight of a 50 wt-% toluene solution of an organic zirconium compound (cetylacetone zirconium butyrate) with stirring to make a solution which was then filtered to obtain an undercoat layer-forming coating solution.

The coating solution thus obtained was applied to a 30 mmϕ aluminum substrate to a dry thickness of 1 μm, and then dried and cured at a temperature of 170° C. for 10 minutes to form an undercoat layer.

A mixture of 15 parts by weight of titanyl phthalocyanine as a charge-generating material, 10 parts by weight of a polyvinyl butyral resin (S-LEC BM-S, available from Sekisui Chemical Co., Ltd.) and 300 parts by weight of n-butyl alcohol was then subjected to dispersion by means of a sandmill for 4 hours. The dispersion thus obtained was applied to the foregoing undercoat layer, and then dried to form a charge-generating layer having a thickness of 0.2 μm thereon.

Subsequently, a charge-transporting layer coating solution comprising 90 parts by weight of tri(p-methylphenyl)amine as a charge-transporting material, 100 parts by weight of a polycarbonate resin (C-1400, available from TEIJIN LTD.), 0.002 parts by weight of a silicone oil (KF-54, available from Shin-Etsu Chemical Co., Ltd.) and 870 parts by weight of tetrahydrofuran was prepared. The coating solution thus prepared was applied to the foregoing charge-generating layer, and then dried to a charge-transporting layer having a thickness of 24 μm. Thus, an electrophotographic photoreceptor consisting of three layers was prepared.

Using an apparatus for evaluating electrical properties, the electrophotographic photoreceptor thus obtained was charged to −700 V, exposed to light at a predetermined exposure, and then measured for potential. The results are set forth in Table 6.

EXAMPLES 16–23

The procedure of Example 15 was followed to prepare an electrophotographic photoreceptor except that the mixtures set forth in Table 6 were used respectively instead of 2,3-dimethoxy-5-methyl-1,4-benzoquinone. The electrophotographic photoreceptor thus prepared was then evaluated in the same manner as in Example 15. The results are set forth in Table 6.

COMPARATIVE EXAMPLE 12

The procedure of Example 15 was followed to form a charge-generating layer and a charge-transporting layer constituting an electrophotographic photoreceptor except that as the undercoat layer-forming coating solution a coating solution obtained by dissolving 1 part by weight of a polyvinyl butyral resin in 10 parts by weight of toluene was used to form an undercoat layer having a thickness of 1 μm. The electrophotographic photoreceptor thus prepared was then evaluated in the same manner as in Example 15. The results are set forth in Table 6.

TABLE 6

| Example No. | Electron-transporting material | Charged potential | Surface potential after exposure at 2 mJ/m$^2$ (780) | Residual potential |
|---|---|---|---|---|
| Example 15 | 2,3-Dimethoxy-5-methyl-1,4-benzoquinone | −700 | −120 | −81 |
| Example 16 | Quinhydrone | −689 | −103 | −64 |
| Example 17 | 2,4,7-Trinitro-9-fluorenone | −695 | −97 | −63 |

TABLE 6-continued

| Example No. | Electron-transporting material | Charged potential | Surface potential after exposure at 2 mJ/m² (780) | Residual potential |
|---|---|---|---|---|
| Example 18 | 2-Hydroxy-9-fluorenone | −699 | −101 | −67 |
| Example 19 | 3,5-Dimethyl-3',5'-di-tert-butyl-4,4'-diphenoquinone | −700 | −81 | −54 |
| Example 20 | 3,5-Dimethoxy-3',5'-di-tert-butyl-4,4'-diphenoquinone | −697 | −89 | −61 |
| Example 21 | 3,3'-Diethoxy-5,5'-di-tert-butyl-4,4'-diphenoquinone | −700 | −86 | −58 |
| Example 22 | 4-(Butoxy-carbonyl)-9-dicyano-methylene fluorenone | −697 | −93 | −65 |

TABLE 6-continued

| Example No. | Electron-transporting material | Charged potential | Surface potential after exposure at 2 mJ/m² (780) | Residual potential |
|---|---|---|---|---|
| Example 23 | 2-Hydroxy-1,4-naphtho-quinone | −698 | −103 | −91 |
| Comparative Example 12 | Not added | −700 | −640 | −637 |

EXAMPLES 24–32

The procedure of Example 15 was followed to prepare an electrophotographic photoreceptor except that the compounds set forth in Table 7 were used respectively instead of acetylacetone zirconium butyrate and 2,3-dimethoxy-5-methyl-1,4-benzoquinone. The electrophotographic photoreceptor thus prepared was then evaluated in the same manner as in Example 15. The results are set forth in Table 7.

TABLE 7

| Example No. | Organic metal compound/silane coupling agent | Electron-transporting compound | Charged potential | Surface potential after exposure at 2 mJ/m² (780 nm) | Residual potential |
|---|---|---|---|---|---|
| Example 24 | γ-Aminopropyl triethoxysilane | 2,3-Dimethoxy-5-methyl-1,4-benzoquinone | −687 | −105 | −83 |
| Example 25 | γ-Aminopropyl triemthoxysilane | 2,4,7-Trinitro-9-fluorenone | −693 | −110 | −93 |
| Example 26 | Zirconium butyrate dimer | 3,5-Dimethoxy-3',5'-di-tert-butyl-4,4'-diphenoquinone | −696 | −90 | −64 |
| Example 27 | γ-Aminopropyl triethoxysilane | 2-Hydroxy-9-fluorenone | −694 | −101 | −69 |
| Example 28 | Tetranormal butyl titanate | 3,5-Dimethyl-3',5'-di-tert-butyl-4,4'-diphenoquinone | −701 | −95 | −73 |
| Example 29 | 2:1 (by mol) mixture of acetylacetone zirconium butyrate and γ-aminopropyl triethoxysilane | 3,5-Dimethoxy-3',5'-di-tert-butyl-4,4'-diphenoquinone | −699 | −89 | −60 |
| Example 30 | 2:1 (by mol) mixture of acetylacetone zirconium butyrate and γ-aminopropyl triethoxysilane | 3,5-Diethoxy-5,5'-di-tert-butyi-4,4'-diphenoquinone | −700 | −86 | −62 |
| Example 31 | Aluminum isopropylate | 4-(Butoxycarbonyl)-9-dicyanomethylene fluorenone | −693 | −83 | −61 |
| Example 32 | Vinyl trimethoxysilane | 3,5-Dimethyl-3',5'-di-tert-butyl-4,4'-diphenoquinone | −698 | −94 | −74 |

EXAMPLE 33

To 10 parts by weight of tetrahydrofuran were added 5 parts by weight of 3,3',5,5'-tetra-t-butyl-4,4'-diphenoquinone, 40 parts by weight of a 50 wt-% toluene solution of an organic zirconium compound (acetylatone zirconium butyrate) and 20 parts by weight of γ-aminopropyl trimethoxysilane with stirring. The solution was then filtered to obtain an undercoat layer-forming coating solution.

The coating solution thus obtained was then applied to a 30 mmϕ aluminum substrate which had been roughened by liquid honing by ring coating. The coated material was air-dried at room temperature for 5 minutes, and then dried and cured at a temperature of 170° C. for 10 minutes to form an undercoat layer having a thickness of 0.2 μm.

A mixture of 15 parts by weight of hydroxy gallium phthalocyanine as a charge-generating material, 10 parts by weight of a vinyl chloride-vinyl acetate copolymer resin (VMCH, available from Nippon Unicar Company Limited) and 30 parts by weight of n-butyl alcohol was subjected to dispersion by means of a sandmill for 4 hours. The dispersion thus obtained was applied to the foregoing undercoat layer by dip coating method, and then dried to form a charge-generating layer having a thickness of 0.2 μm. 4 parts by weight of N,N'-diphenyl-N,N'-bis(3-methylphenyl)-[1,1'-biphenyl]-4,4'-diamine and 6 parts by weight of a bisphenol Z polycarbonate resin (molecular weight: 40,000) were dissolved in 80 parts by weight of chlorobenzene. The solution thus obtained was applied to the charge-generating layer, and then dried to form a charge-transporting layer having a thickness of 20 μm. Thus, an electrophotographic photoreceptor co nsisting of three layers was prepared.

Using an apparatus for evaluating electrical properties, the electrophotographic photoreceptor thus obtained was charged to −700 V, exposed to light at a predetermined exposure, and then measured for potential. The results are set forth in Table 8.

TABLE 8

| Example No. | Charged potential | Surface potential after exposure at 2 mJ/m² (780 nm) | Residual potential |
|---|---|---|---|
| Example 33 | −700 | −81 V | −40 V |

As mentioned above, the electrophotographic photoreceptor of the present invention comprises a copolymer resin containing a hydrolyzable silyl group and an electron-transporting organic pigment incorporated in the undercoat layer and thus exhibits little residual potential and little environmental dependence of residual potential. Further, the electrophotographic photoreceptor of the present invention can form a high quality copied image without causing current leakage even in the contact-charging process.

The electrophotographic photoreceptor of the present invention comprises a charge-generating layer and a charge-transporting layer sequentially laminated on an electrically-conductive support, characterized in that a cured film made of either or both of an organic metal compound and a silane coupling agent, an electron-receptive compound and a binder resin is provided interposed between said electrically-conductive support and said electron-generating layer as an undercoat layer. In this arrangement, the undercoat layer cannot be eluted during the coating of the upper layer. Thus, the electrophotographic photoreceptor of the present invention exhibits stabilized electrical properties. Further, the combined use of an organic metal compound or silane coupling agent and an electron-receptive compound can provide an electrophotographic photoreceptor which provides excellent electrophotographic properties, i.e., high light decay and low residual potential and a high sensitivity, a high image quality and an excellent repetition stability as compared with the single use of these additives.

What is claimed is:

1. An electrophotographic photoreceptor comprising an electrically-conductive substrate having provided thereon an undercoat layer and a photosensitive layer, wherein said undercoat layer comprises a crosslinkable matrix and an electron-transporting material.

2. The electrophotographic photoreceptor according to claim 1, wherein said crosslinkable matrix is a copolymer resin having a hydrolyzable silyl group.

3. The electrophotographic photoreceptor according to claim 2, wherein said copolymer resin having a hydrolyzable silyl group is selected from the group consisting of an acrylic copolymer resin and a copolymer resin made of a vinyl monomer having a hydrolyzable silyl group and a vinyl monomer copolymerizable with said vinyl monomer.

4. The electrophotographic photoreceptor according to claim 2, wherein said hydrolyzable silyl group is an alkoxysilyl group.

5. The electrophotographic photoreceptor according to claim 1, wherein said electron-transporting material is an electron-transporting organic pigment.

6. The electrophotographic photoreceptor according to claim 5, wherein said electron-transporting organic pigment is a pigment selected from the group consisting of a polycyclic quinone pigment, a perylene -pigment and a naphthalene tetracarboxylic diimidazole pigment.

7. The electrophotographic photoreceptor according to claim 1, wherein said electron-transporting material is a diphenoquinone compound.

8. The electrophotographic photoreceptor according to claim 7, wherein said electron-transporting material has a hydrolyzable polymerizable substituent.

9. The electrophotographic photoreceptor according to claim 1, wherein said undercoat layer comprises at least one of a silane coupling agent and an organic metal compound.

10. The electrophotographic photoreceptor according to claim 9, wherein said organic metal compound is selected from the group consisting of a zirconium compound, a titanium compound, an aluminum compound and an manganese compound.

11. The electrophotographic photoreceptor according to claim 9, wherein said electron-transporting material is selected from the group consisting of quinones, anthraquinones, naphthoquinones, benzoquinones, pyrimidines, diphenoquinones, fluorenones, xanthones, 4-(butoxycarbonyl)-9-dicyanomethylenefluorenone, anthraquinonedimethanes, dinitrobenzene, dinitroanthracene, dinitroacrydine, chloranyl, chloranylic acid, bromanyl and 2,6-di-tert-butyl-4-dicyanomethylene-4-H-thiopyrane-1,1-dioxide.

12. The electrophotographic photoreceptor according to claim 1, wherein said photosensitive layer is a laminate of a charge-generating layer and a charge-transporting layer.

13. The electrophotographic photoreceptor according to claim 1, wherein said photosensitive layer comprises a positive hole-transporting charge-transporting layer laminated on a charge-generating layer.

14. A process for forming an image which comprises the steps of:

charging an electrophotographic photoreceptor;

subjecting the electrophotographic photoreceptor thus charged to imagewise exposure; and developing the electrophotographic photoreceptor thus exposed, wherein said electrophotographic photoreceptor comprises an electrically-conductive substrate having provided thereon an undercoat layer and a photosensitive layer, wherein said undercoat layer comprises a crosslinkable matrix and an electron-transporting material, and wherein a charging apparatus is brought into contact with the surface of said electrophotographic photoreceptor so that electric charge is externally supplied thereinto to charge said electrophotographic photoreceptor.

15. An image forming apparatus comprising an electrophotographic photoreceptor and a charging apparatus, wherein said electrophotographic photoreceptor comprises an electrically-conductive substrate having provided thereon an undercoat layer and a photosensitive layer, wherein said undercoat layer comprises a crosslinkable matrix and an electron-transporting material, and wherein said charging apparatus is brought into contact with the surface of said electrophotographic photoreceptor so that electric charge is externally supplied thereinto to charge said electrophotographic photoreceptor.

* * * * *